US005948727A

United States Patent [19]

Hotta et al.

[11] Patent Number: 5,948,727

[45] Date of Patent: Sep. 7, 1999

[54] REVERSIBLE THERMOSENSITIVE RECORDING MEDIUM AND IMAGE FORMING AND ERASING METHOD USING THE SAME

[75] Inventors: Yoshihiko Hotta; Akira Suzuki, both of Mishima; Takashi Kitamura, Ichikawa, all of Japan

[73] Assignee: Ricoh Company, Ltd., Tokyo, Japan

[21] Appl. No.: 08/520,719

[22] Filed: Aug. 29, 1995

[30] Foreign Application Priority Data

Aug. 29, 1994 [JP] Japan ..... 6-227273
Aug. 25, 1995 [JP] Japan ..... 7-240961

[51] Int. Cl.[6] ..... B41M 5/40

[52] U.S. Cl. ..... 503/200; 427/152; 503/201; 503/226

[58] Field of Search ..... 427/152; 503/200, 503/209, 226

[56] References Cited

U.S. PATENT DOCUMENTS 4,487,144 12/1984 Bianchi ..... 428/321.5
4,880,768 11/1989 Mochizuki et al. ..... 503/227
5,019,550 5/1991 Suzuki et al. ..... 503/227
5,039,369 8/1991 Suzuki et al. ..... 156/234
5,049,538 9/1991 Mochizuki et al. ..... 503/227
5,144,334 9/1992 Suzuki et al. ..... 346/1.1
5,198,061 3/1993 Suzuki et al. ..... 156/234
5,278,128 1/1994 Hotta et al. ..... 503/207
5,321,239 6/1994 Masabuchi et al. ..... 235/380
5,448,065 9/1995 Masabuchi et al. ..... 250/316.1
5,489,494 2/1996 Hotta et al. ..... 430/19
5,538,822 7/1996 Hotta et al. ..... 430/19
5,627,126 5/1997 Amano et al. ..... 503/226

FOREIGN PATENT DOCUMENTS 64-14077 1/1989 Japan ..... 503/209

*Primary Examiner*—Bruce H. Hess
*Attorney, Agent, or Firm*—Oblon, Spivak, McClelland, Maier & Neustadt, P.C.

[57] ABSTRACT

A reversible thermosensitive recording medium includes a support and a composite laminated recording layer formed on the support, the composite laminated recording layer including a reversible thermosensitive recording layer whose transparency or color reversibly changes by the application of heat thereto and a light-to-heat converting layer containing a light-to-heat converting material and a resin, and the composite laminated recording layer having a thermal pressure level difference of 40% or less.

18 Claims, 10 Drawing Sheets

(a)

(b)

(c)

(d)

(e)

(f)

(a)

(b)

(c)

(d)

(e)

(a)

(b)

(c)

(d)

(a)

(c)

(b)

(a)

(b)

(a)

(b)

REVERSIBLE THERMOSENSITIVE RECORDING MEDIUM AND IMAGE FORMING AND ERASING METHOD USING THE SAME

BACKGROUND OF THE INVENTION

1. Field of the Invention

The present invention relates to a reversible thermosensitive recording medium, more particularly to a reversible thermosensitive recording medium comprising a reversible thermosensitive recording layer, with the transparency or color thereof being reversibly changeable depending upon the temperature thereof, which is capable of repeatedly recording information therein and erasing recording information therefrom by utilizing the reversibly changeable transparency or color of the reversible thermosensitive recording layer. The present invention also relates to a method of forming images in the above-mentioned reversible thermosensitive recording medium and erasing the same therefrom by applying a laser beam thereto.

2. Discussion of Background

Recently, reversible thermosensitive recording media, which are capable of temporarily forming images therein and also capable of deleting formed images therefrom when such formed images becomes unnecessary, have attracted attention.

Japanese Laid-Open Patent Applications 54-119377 and 55-154198 disclose representative examples of such a reversible thermosensitive recording medium, which comprises an organic low-molecular weight material such as a higher fatty acid, which is dispersed in a matrix resin such as a vinyl chloride—vinyl acetate copolymer.

However, such a reversible thermosensitive recording medium has the shortcoming that the surface of the reversible thermosensitive recording medium takes scratches when a thermal head is employed as a heating element, and therefore, it becomes difficult to form uniform images in the recording medium during repeated image formation and erasure. This is because such a heating element is rubbed against the surface of the recording medium with the application of heat thereto.

In order to decrease the scratches on the surface of the recording medium when the thermal head is used as the heating element, the inventors of the present invention have proposed the provision of a protective layer on the surface of the recording medium, as disclosed in Japanese Laid-Open Patent Applications 63-221097, 63-317385 and 2-566. However, the provision of the protective layer is not enough to protect the surface of the recording medium from the scratches when the image formation and erasure are repeated many times.

The other shortcoming of the conventional reversible thermosensitive recording medium in which the organic low-molecular-weight material is dispersed in the matrix resin is that the organic low-molecular-weight material tends to aggregate, and the milky whiteness degree of the reversible thermosensitive recording layer is therefore gradually decreased as the image formation and image erasure are repeatedly carried out by simultaneously applying heat and pressure to the recording medium, for example, using the thermal head.

To prevent such deterioration of the recording medium, there is known a method of heating a reversible thermosensitive recording layer of the recording medium not in contact with a heating element. According to the above-mentioned non-contact heating method, the reversible thermosensitive recording layer is softened by the application of heat thereto, but not impaired because no pressure is applied thereto, thereby preventing the deterioration of the reversible thermosensitive recording medium. For instance, the recording is carried out in the reversible thermosensitive recording medium by use of a laser beam as disclosed in Japanese Laid-Open Patent Application 57-82088. In this case, carbon black and a resin such as ethylcellulose are contained in the reversible thermosensitive recording layer or a layer adjacent to the reversible thermosensitive recording layer. This method enables the recording to be carried out by the non-contact heating system. However, the images formed in the reversible thermosensitive recording medium become grayish as a whole and the image contrast is considerably poor not only when the carbon black is added to the reversible thermosensitive recording layer, but also when it is added to the layer adjacent to the reversible thermosensitive recording layer.

In addition, as disclosed in Japanese Laid-Open Patent Application 64-14077, it is proposed to add a dye to the reversible thermosensitive layer or provide a dye-containing layer or metallic layer capable of absorbing near infrared rays in immediate proximity to the reversible thermosensitive layer.

When the dye is contained in the reversible thermosensitive recording layer, the contrast of the obtained images is not sufficient for practical use although it becomes better as compared with the case where the carbon black is employed.

When the carbon black or dye is contained in the reversible thermosensitive layer or the layer adjacent thereto, a thermoplastic resin is generally used in combination with the carbon black or dye in the layer. Therefore, when the laser beam is applied to the recording medium for recording operation, a very tiny area is instantaneously heated to high temperature and the thermoplastic resin is softened, with the result that the layer will be deformed as a whole.

When the near-infrared-rays-absorbing layer made from metals such as Se, Ge and Cr is provided adjacent to the reversible thermosensitive layer, the problem of thermal deformation does not occur, but the image contrast is decreased because the metallic luster of the above-mentioned metals is relatively low. In addition, the above-mentioned metals have toxicity, so that the recording medium cannot be discarded without any treatment when it becomes unnecessary.

SUMMARY OF THE INVENTION

It is therefore a first object of the present invention to provide a reversible thermosensitive recording medium which is improved with respect to the repeated use durability, for instance, when a thermal head or the like is used for image formation and erasure.

A second object of the present invention is to provide a reversible thermosensitive recording medium which is highly sensitive and is capable of producing images therein with high contrast without thermal deformation of the recording medium when a laser beam is applied to the recording medium for image formation and erasure.

A third object of the present invention is to provide a reversible thermosensitive recording medium which is safety and capable of being discarded without environmental pollution.

A fourth object of the present invention is to provide a method of repeatedly forming clear images in a reversible thermosensitive recording medium and erasing the images therefrom uniformly by the application of a laser beam thereto in an effective manner, without the variation of sensitivity of the recording medium depending upon the change of ambient temperature.

The above-mentioned first to third objects of the present invention can be achieved by a reversible thermosensitive recording medium comprising a support and a composite laminated recording layer formed on the support, the composite laminated recording layer comprising (a) a reversible thermosensitive recording layer whose transparency or color reversibly changes by the application of heat thereto and (b) a light-to-heat converting layer comprising a light-to-heat converting material and a resin, and the composite laminated recording layer having a thermal pressure level difference of 40% or less. In this case, it is preferable that the thermal pressure level difference of each of the light-to-heat converting layer and the reversible thermosensitive recording layer be 40% or less.

In the above-mentioned reversible thermosensitive recording medium, it is preferable that the composite laminated recording layer have a thermal pressure level difference change ratio of 70% or less, and the reversible thermosensitive recording layer have a thermal pressure level difference change ratio of 70% or less.

For the above first to third objects of the present invention, the composite laminated recording layer for use in the above-mentioned reversible thermosensitive recording medium may further comprise a light reflection layer. In this case, it is preferable that the light reflection layer comprise a plurality of separate light reflection layer portions.

The previously mentioned first to third objects of the present invention can also be achieved by a reversible thermosensitive recording medium comprising a support, and a composite laminated recording layer formed on the support, which composite laminated recording layer comprises a reversible thermosensitive recording layer whose transparency or color reversibly changes by the application of heat thereto and which comprises a light-to-heat converting material and has a thermal pressure level difference of 40% or less. In this case, it is preferable that the reversible thermosensitive recording layer have a thermal pressure lvel difference change ratio of 70% or less.

In the above-mentioned reversible thermosensitive recording medium, the composite laminated recording layer may further comprise a light reflection layer. In such a case, it is preferable that the light reflection layer comprise a plurality of separate light reflection layer portions.

In addition, for the above-mentioned objects of the present invention, it is preferable that the softening-initiation temperature of the above-mentioned reversible thermosensitive recording layer be in a range of 30 to 120° C.

The fourth object of the present invention can be achieved by a method of forming images in a reversible thermosensitive recording medium and erasing the images therefrom comprising the steps of preheating the reversible thermosensitive recording medium to a predetermined temperature, and applying a laser beam to the recording medium to form images and/or erase the images.

In the above-mentioned image forming and erasing method, when the reversible thermosensitive recording medium comprises a reversible thermosensitive recording layer whose transparency reversibly changes by the application of heat thereto, and which comprises a matrix resin and an organic low-molecular-weight material dispersed in the form of particles in the matrix resin, the preheating temperature of the reversible thermosensitive recording medium may be a temperature higher than the minimum crystallization temperature of the organic low-molecular-weight material.

In addition, the fourth object of the present invention can also be achieved by a method of forming images in a reversible thermosensitive recording medium and erasing the images therefrom by the application of a laser beam to the recording medium, under control of at least one factor selected from the group consisting of the radiation time of the laser beam, the amount of the applied laser beam, the focusing of the applied laser beam, and the intensity distribution of the applied laser beam.

BRIEF DESCRIPTION OF THE DRAWINGS

A more complete appreciation of the invention and many of the attendant advantages thereof will readily obtained as the same becomes better understood by reference to the following detailed description when considered in connection with the accompanying drawings, wherein:

FIG. 6(*b*) is a side view of the thermal pressure application apparatus shown in FIG. 6(*a*);

FIG. 6(*c*) is an enlarged view of a temperature regulator unit of the thermal pressure application apparatus shown in FIG. 6(*a*);

FIG. 13(*b*) is a schematic diagram showing that the recording is carried out in a reversible thermosensitive recording medium of the present invention comprising a light reflection layer.

DESCRIPTION OF THE PREFERRED EMODIMENTS

The structure of a reversible thermosensitive recording medium of the present invention will now be explained by referring to FIGS. 1 to 5.

Figure 1:
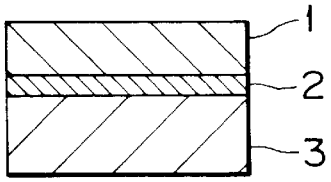
FIGS. 1 to 5 are schematic cross-sectional views of reversible thermosensitive recording media according to the present invention, in explanation of the structure of layers.
Figure 1:
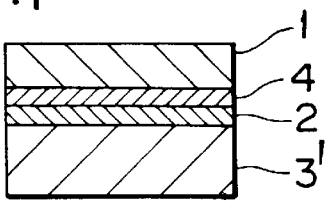
Figure 1:
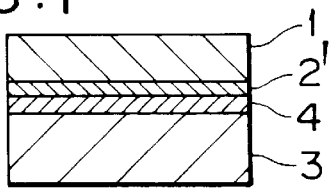
Figure 1:
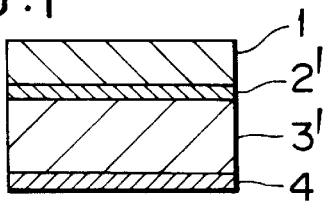
Figure 1:
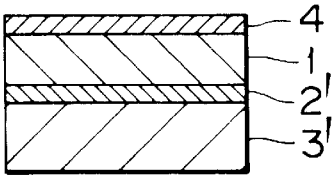
Figure 1:
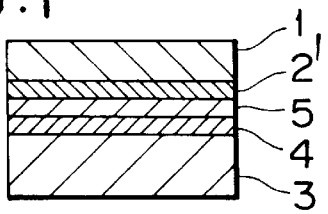

A reversible thermosensitive recording medium shown in FIG. 1(*a*), which shows a basic structure, comprises a support 3, a light-to-heat converting layer 2 formed on the support 3, and a reversible thermosensitive layer 1 formed on the light-to-heat converting layer 2.

In the recording medium of FIG. 1(*a*), it is said that a composite laminated recording layer comprising the light-to-heat converting layer 2 and the reversible thermosensitive recording layer 1 is formed on the support 3. In the present invention, the above-mentioned composite laminated recording layer may further comprise a light reflection layer.

In a reversible thermosensitive recording medium shown in FIG. 1(*b*), a light reflection layer 4 is provided between a light-to-heat converting layer 2 and a reversible thermosensitive layer 1. In this case, it is necessary to employ a transparent support 3' when the radiation of a laser beam is taken into consideration.

In a reversible thermosensitive recording medium shown in FIG. 1(*c*), a light reflection layer 4 is provided between a support 3 and a transparent light-to-heat converting layer 2'. In this case, it is necessary that the light-to-heat converting layer 2' be transparent in order to recognize the images formed in the reversible thermosensitive layer 1.

In a reversible thermosensitive recording medium shown in FIG. 1(*d*), a light reflection layer 4 is provided on the back surface of a support 3', opposite to a light-to-heat converting layer 2' with respect to the support 3'. In this case, it is necessary that both of the light-to-heat converting layer 2' and the support 3' be transparent in order to recognize the images formed in the reversible thermosensitive layer 1.

In a reversible thermosensitive recording medium shown in FIG. 1(*e*), a light reflection layer 4 is provided on a reversible thermosensitive layer 1. In this case, it is necessary that both of the light-to-heat converting layer 2' and the support 3' be transparent in order to recognize the images formed in the reversible thermosensitive layer 1.

Figure 2:
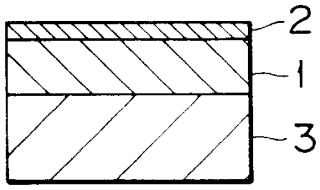
Figure 2:
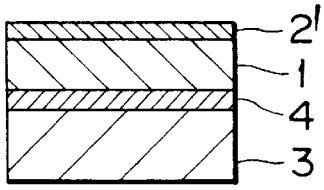
Figure 2:
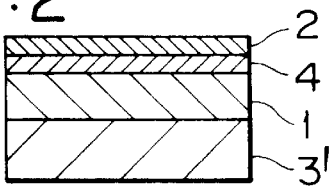
Figure 2:
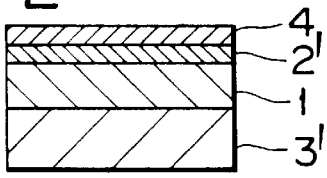
Figure 2:
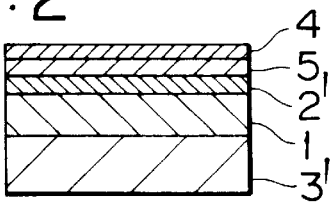

A reversible thermosensitive recording medium shown in FIG. 2(*a*) comprises a support 3, a reversible thermosensitive layer 1 formed on the support 3, and a light-to-heat converting layer 2 formed on the reversible thermosensitive layer 1. The overlaying order of the reversible thermosensitive layer 1 and the light-to-heat converting layer 2 in the composite laminated recording layer is reversed when compared with the recording medium shown in FIG. 1(*a*). In this case, the composite laminated recording layer may also further comprise a light reflection layer.

In a reversible thermosensitive recording medium shown in FIG. 2(*b*), a light reflection layer 4 is provided between a support 3 and a reversible thermosensitive layer 1. In this case, it is necessary to employ a transparent light-to-heat converting layer 2' to recognize the images obtained in the reversible thermosensitive layer 1.

In a reversible thermosensitive recording medium shown in FIG. 2(*c*), a light reflection layer 4 is provided between a reversible thermosensitive layer 1 and a light-to-heat converting layer 2. In this case, it is necessary that a support 3' be transparent in order to recognize the images formed in the reversible thermosensitive layer 1.

In a reversible thermosensitive recording medium shown in FIG. 2(*d*), a light reflection layer 4 is provided on a heat-to-light converting layer 2'. In this case, it is necessary that both of the light-to-heat converting layer 2' and the support 3' be transparent to the visible light when the radiation of a laser beam and the recognition of the obtained images are taken into consideration.

Figure 3:
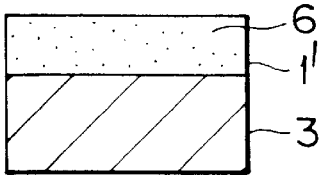
Figure 3:
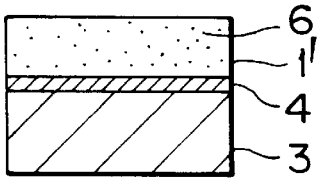
Figure 3:
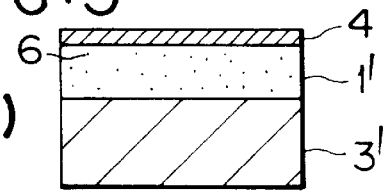
Figure 3:
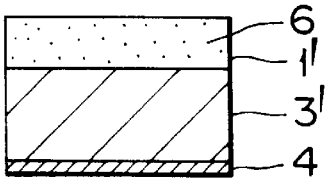

A reversible thermosensitive recording medium shown in FIG. 3(*a*) comprises a support 3 and a reversible thermosensitive layer 1' formed on the support 3, which comprises a light-to-heat converting material 6.

In a reversible thermosensitive recording medium shown in FIG. 3(*b*), a light reflection layer 4 is provided between a support 3 and a reversible thermosensitive layer 1'.

In a reversible thermosensitive recording medium ahown in FIG. 3(*c*), a light reflection layer 4 is provided on a reversible thermosensitive layer 1'. In this case, it is necessary that a support 3' be transparent when the radiation of a laser beam and the recognition of the images obtained in the reversible thermosensitive layer 1' are taken into consideration.

In a reversible thermosensitive recording medium shown in FIG. 3(*d*), a light reflection layer 4 is provided on the back surface of a support 3', opposite to a reversible thermosensitive layer 1' with respect to the support 3'. In this case, it is necessary that the support 3' be transparent in order to recognize the images formed in the reversible thermosensitive layer 1'.

Reversible thermosensitive recording media shown in FIG. 1(*f*) and FIG. 2(*e*) comprise a heat-insulating layer to improve the thermal sensitivity. The recording medium shown in FIG. 1(*f*) is the same as that shown in FIG. 1(*c*) except that a heat-insulating layer 5 is interposed between the light reflection layer 4 and the transparent light-to-heat converting layer 2'. The recording medium shown in FIG. 2(*e*) is the same as that shown in FIG. 2(*d*) except that a heat-insulating layer 5 is interposed between the transparent light-to-heat converting layer 2' and the light reflection layer 4.

Figure 4:
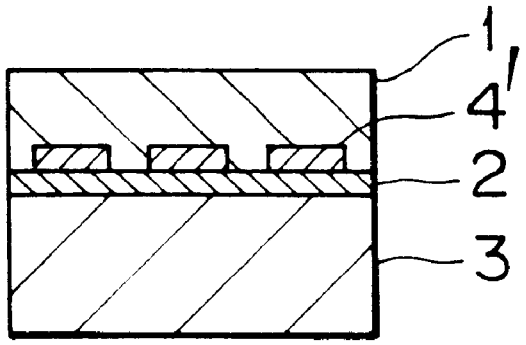

A reversible thermosensitive recording medium shown in FIG. 4 is the same as that shown in FIG. 1(*b*) except that a light reflection layer 4' comprises a plurality of separate light reflection layer portions. Such separate light reflection layer portions can be applied to all the examples shown in FIG. 1 to FIG. 3.

Figure 5:
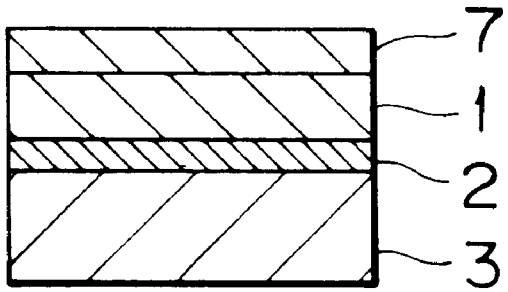

A reversible thermosensitive recording medium of the present invention may further comprise a protective layer as shown in FIG. 5. In the reversible thermosensitive recording medium shown in FIG. 5, a light-to-heat converting layer 2, a reversible thermosensitive layer 1 and a protective layer 7 are successively overlaid on a support 3. The protective layer 7 is applicable to all the examples an shown in FIGS. 1 to 4 to protect the light reflection layer, the light-to-heat converting layer, the support or the reversible thermosensitive layer.

Furthermore, to improve the adhesion between the previously mentioned adjoining layers there may be provided a layer, preferably comprising a resin as the main component. In this case, it is preferable that the thermal pressure level difference of such a resin layer be controlled to 40% or less.

The thermal pressure level difference in the reversible thermosensitive recording medium of the present invention is defined as follows:

The thermal pressure level difference is a physical value indicating the hardness of a coated film when heated. The smaller the value, the harder the coated film. When the value of the thermal pressure level difference is 40% or less, the advantages of the present invention over the conventional reversible thermosensitive recording media, particularly the durability at the time of repeated image formation and erasure, for instance, by use of a laser beam, can be effectively obtained. It is considered that this is because when the value of the thermal pressure level difference is 40% or less, the resin component for use in each layer can be restrained from softening when heated to a high temperature. Therefore, even though a part of the recording medium is extremely heated when irradiated by a laser beam, deformation of the light-to-heat converting layer, the reversible thermosensitive layer or the light reflection layer, and the composite laminated recording layer comprising the above-mentioned layers can be minimized.

The method of measuring the thermal pressure level difference of the light-to-heat converting layer for use in the reversible thermosensitive recording medium will be now described. The same method can be applied when the thermal pressure level difference of the reversible thermosensitive layer, the light reflection layer, or the composite laminated recording layer comprising such two or three layers is measured.

Figure 6:
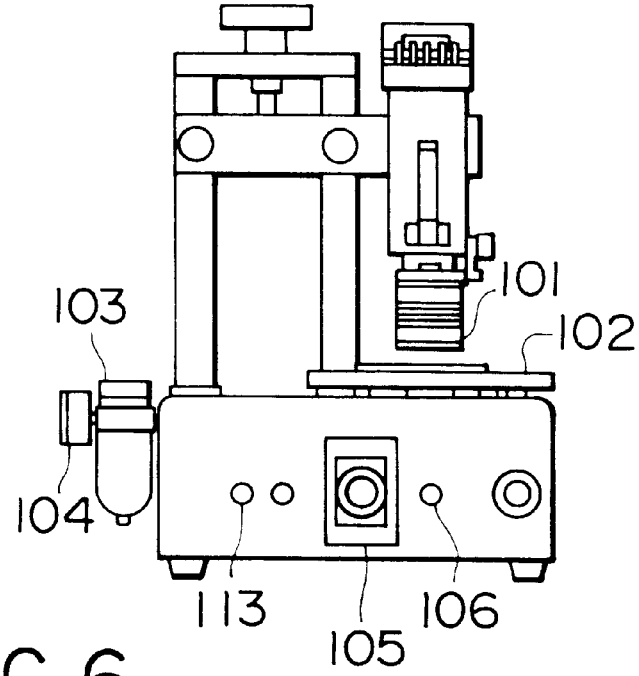
FIG. 6(*a*) is a front view of a thermal pressure application apparatus for the measurement of the thermal pressure level difference.
Figure 6:
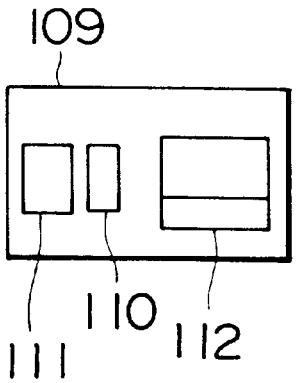
Figure 6:
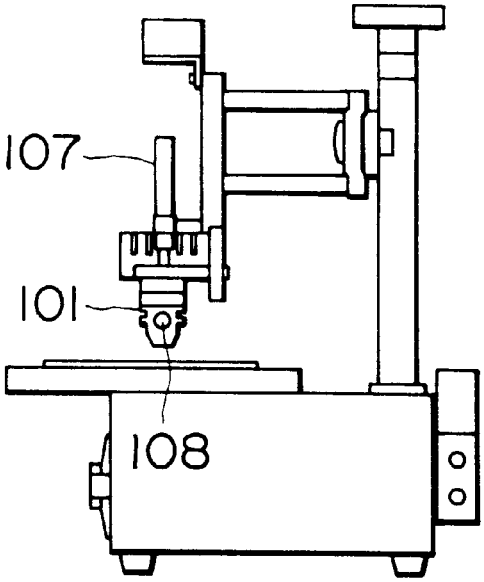

A thermal pressure application apparatus for the measurement of the thermal pressure level difference is as shown in FIG. 6(*a*). More specifically, the thermal pressure application apparatus shown in FIG. 6(*a*) is a desk-top hot-stamp air type TC film erasure test machine made by Unique Machinery Company, Ltd.

FIG. 6(*a*) is a schematic front view of the thermal pressure application apparatus, and FIG. 6(*b*) is a schematic side view of the thermal pressure application apparatus of FIG. 6(*a*).

As shown in FIG. 6(*a*) and FIG. 6(*b*), the thermal pressure application apparatus comprises an air regulator 103 for pressure adjustment, a thermal-pressure-application timer 105 for time adjustment, a temperature regulator 112 for temperature adjustment (shown in FIG. 6(*c*)), a thermal-pressure-application head 101 for applying heat and pressure to a test sample, and a sample support 102 for supporting a test sample thereon.

Figure 7:
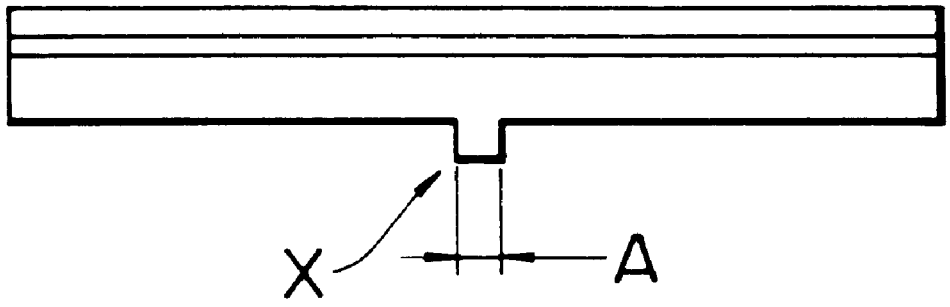
FIGS. 7(*a*) and 7(*b*) are respectively a front view and a side view of a thermal-pressure-application head for use in the thermal pressure application apparatus shown in FIG. 6(*a*)
Figure 7:
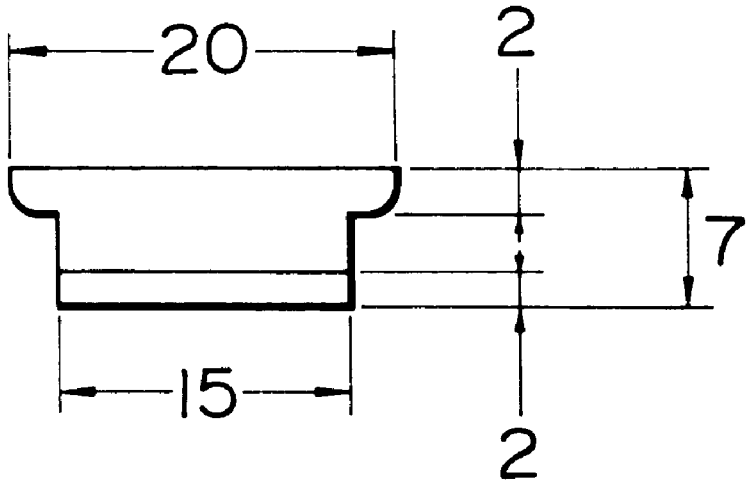

The thermal-pressure-application head 101 is modified for the measurement of the thermal pressure level difference of a test sample of a reversible thermosensitive recording medium, and more specifically, a head as shown in FIG. 7 is employed for the apparatus.

As the material for the thermal-pressure-application head 101, aluminum is employed. The surface roughness (Ry) of the projected portion X of the head 101 shown in FIG. 7(*a*) which comes in contact with the surface of the test sample is set to 0.8 $\mu$m or less in accordance with Japanese Industrial Standards (JIS) B0031-1982 and B0601-1994. The cross-section area A of the projected portion X, which comes in contact with the test sample is 0.225 $cm^2$.

Figure 8:
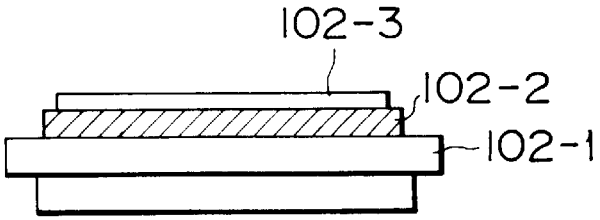
FIG. 8 is a schematic cross-sectional view of a sample support for placing a sample of a reversible thermosensitive recording medium to be tested in the thermal pressure application apparatus shown in FIG. 6(*a*)

On the sample support 102 shown in FIG. 6(*a*), there is provided a composite plate composed of an aluminum plate 102-1, a fluorine rubber layer 102-2 with a thickness of 1 mm provided on the aluminum plate 102-1, and a stainless steel plate 102-3 with a thickness of 1 mm and a spring hardness of HS65 provided on the fluorine rubber layer 102-2 as shown in FIG. 8, in order to prevent the pressure applied at thermal pressure application from being dispersed.

In FIGS. 6(*a*) and 6(*b*), reference numeral 106 indicates a one-shot switch; reference numeral 107, a printing cylinder; reference numeral 109, a control box; reference numeral 110, an instruction switch for hot-stamp; reference numeral 111, a power switch; and reference numeral 113, a temperature alarm lamp.

When the thermal pressure level difference of the test sample is measured by using the thermal pressure application apparatus as shown in FIG. 6(*a*) and FIG. 6(*b*), the thermal pressure application conditions are as follows:

The air regulator 103 shown in FIG. 6(*a*) is adjusted to obtain such a pressure that the air gauge pressure value in an air gauge 104 shown in FIG. 6(*a*) is 2.5 $kg/cm^2$. The thermal-pressure-application timer 105 shown in FIG. 6(*a*) is then adjusted in such a manner that the thermal-pressure-application time is set at 10 seconds. Furthermore, the temperature regulator 112 is adjusted in such a manner that the temperature is set at 130° C.

The temperature mentioned here is the temperature adjusted by a heater & temperature sensor 108 shown in FIG. 6(*b*), and is approximately the same as the temperature of the surface of the head 101.

A method of measuring the value of the thermal pressure level difference of a sample to which a thermal pressure is applied by the above-mentioned thermal pressure application apparatus will now be explained.

As the measuring instruments, a two-dimensional roughness analyzer "Surfcorder AY-41" (Trademark), a recorder "RA-60E" (Trademark), and "Surfcorder SE30K" (Trademark), made by Kosaka Laboratory Co., Ltd. are employed.

The measurement conditions for "Surfcorder SE30K" are set, for example, in such a manner that the vertical magnification (V) is 2,000, and the horizontal magnification (H) is 20.

The measurement conditions for "Surfcoder AY-41" are set, for example, in such a manner that the standard length (L) is 5 mm, and the stylus scanning speed (DS) is 0.1 mm/sec. The measured results are recorded in charts by use of the recorder "RA-60E". The value of the thermal pressure level difference ($D_x$) in the thermal pressure applied portion is read from the charts in which the measured results are recorded.

The above-mentioned measurement conditions are exemplary and can be changed as desired when necessary.

Figure 9:
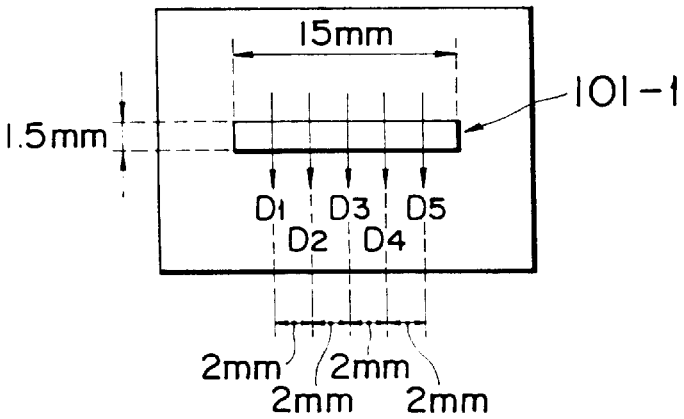
FIG. 9 is a schematic enlarged illustration of a portion of a sample subjected to measurement of the thermal pressure level difference (Dx) thereof.

In practice, the value of the thermal pressure level difference ($D_x$) is measured at 5 points, $D_1$ to $D_5$, with intervals of 2 mm therebetween in the width direction of a thermal pressure applied portion 101-1, as illustrated in FIG. 9, and the average value is obtained as the average thermal pressure level difference ($D_m$). The thermal pressure level difference (D) of the light-to-heat converting layer can be obtained from the average thermal pressure level difference ($D_m$) and the thickness ($D_B$) of the light-to-heat converting layer in accordance with the following formula:

$$D(\%)=(D_m/D_B)\times 100$$

wherein D is the thermal pressure level difference (%), $D_m$ is the average thermal pressure level difference ($\mu$m), and $D_B$ is the thickness ($\mu$m) of the light-to-heat converting layer.

The above-mentioned thickness $D_B$ is the thickness of the light-to-heat converting layer formed on the support and can be measured by inspecting the cross section of the light-to-heat converting layer by a transmission electron microscope (TEM) or a scanning electron microscope (SEM).

The change ratio of the thermal pressure level difference is a physical value indicating the change of the hardening degree of a coated film with time when heated. The smaller the value, the stabler the coated film. When the change ratio of the thermal pressure level difference of the reversible thermosensitive layer, or the composite laminated recording layer comprising the reversible thermosensitive layer and the light-to-heat converting layer, or the composite laminated recording layer comprising the reversible thermosensitive layer, the light-to-heat converting layer and the light reflection layer is 70% or less, the advantages of the present invention over the conventional reversible thermosensitive recording media, particularly, the wide transparent temperature range and the stability thereof, are conspicuously obtained. It is considered that this is because the stability of the thermal physical properties of the coated film is particularly improved difference is 70% or less.

The change ratio of the thermal pressure level difference can be determined in accordance with the following formula:

$$D_C(\%) = \left|\frac{D_I - D_D}{D_I}\right| \times 100$$

wherein $D_C$ is the change ratio of the thermal pressure level difference (%), $D_I$ is the initial thermal pressure level difference (%), and $D_D$ is the thermal pressure level difference changed with time (%).

In the above, the initial thermal pressure level difference ($D_I$) is the value of the thermal pressure level difference of a sample image display portion measured for the first time after the formation of the sample image display portion. This is not necessarily the value measured immediately after the formation of the sample image display portion.

The thermal pressure level difference changed with time ($D_D$) is the value of the thermal pressure level difference of a sample image display portion which is prepared at the same time as that of the preparation of the sample image display portion for the measurement of the initial thermal pressure level difference ($D_I$) thereof and is then allowed to stand at 50° C. for 24 hours.

These values of the thermal pressure level difference are measured by the previously mentioned measurement method and then calculated in the same manner as mentioned previously.

In the case where these thermal pressure level differences cannot be measured under the same conditions (2.5 kg/cm$^2$, 130° C.) as mentioned previously, the pressure and temperature may be changed appropriately.

The reversible thermosensitive recording medium of the present invention has a variety of layer structures, as explained in FIGS. 1 to 5. When it is difficult to measure the thermal pressure level difference of a sample layer because there is provided a relatively soft layer under the test sample layer of which thermal pressure level difference is measured, the sample layer may be peeled by using a cutter and subjected to the measurement. In contrast to this, it is not necessary to peel off a test sample layer for the measurement of the thermal pressure level difference if the sample layer is provided on a relatively hard material such as a support. However, if a layer such as a protective layer is provided on the sample layer, it is necessary to expose the sample layer by eliminating the protective layer therefrom. In this case, the thickness of the protective layer is measured by the cross section inspection thereof by using TEM or SEM, and the protective layer may be scraped off.

Figure 10:
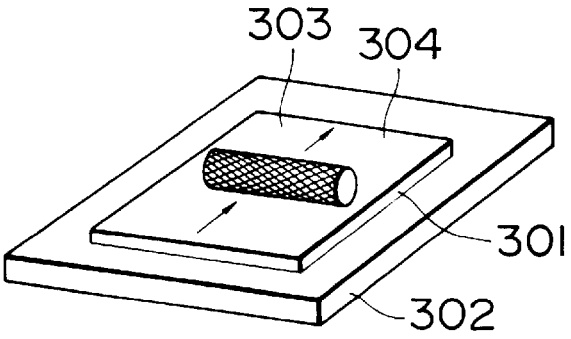
FIG. 10 is a schematic illustration of a method for scraping a protective layer off a reversible thermosensitive recording layer.

The protective layer can be scraped off the sample layer by the method as illustrated in FIG. 10.

As illustrated in FIG. 10, a reversible thermosensitive recording medium 301 including a protective layer is fixed on a stainless steel plate support 302 with a thickness of 2 mm in such a posture that the protective layer thereof in situated on the top surface of the recording medium 301.

A surface cutting member 303 as shown in FIG. 10 is composed of (a) a brass cylinder with a diameter of 3.5 cm and (b) a sand-paper (roughness No. 800) with which the brass cylinder is wrapped. The surface cutting member 303 is put on the protective layer and moved in the direction of the arrow 304, without being rotated. The pressure to be applied in the vertical direction with respect to the surface of the protective layer is in a range of 1.0 to 1.5 kg/cm$^2$. The number of the repetition of the movement of the surface cutting member 303 along the protective layer is determined as follows: The thickness of the recording medium 301 is measured by an electronic micrometer (film thickness meter) prior to the scraping operation. The surface cutting member 303 may be repeatedly moved as the thickness of the recording medium 301 is measured. The scraping operation may be continued until the total thickness is decreased by the thickness of the protective layer.

Even if the exposed surface of a sample layer of the recording medium is roughened after the protective layer is scraped off the sample layer, the thermal pressure level difference of the sample layer can be properly measured without being effected by the surface roughness thereof.

In the case where an intermediate layer is interposed between the protective layer and the sample layer, and also in the case where a printed layer is provided on the protective layer, and even in the case where a heat resistant film is applied to the sample layer, the above-mentioned method for measuring the thermal pressure level difference can be employed by exposing the surface of the sample layer in the same manner as mentioned above. Similarly, the thermal pressure level difference and the thermal pressure level difference change ratio of a composite laminated layer comprising two or three layers can also be measured.

As previously mentioned, the objects of the present invention can be attained when a composite laminated recording layer comprising the reversible thermosensitive recording layer and the light-to-heat converting layer for use in the reversible thermosensitive recording medium has a thermal pressure level difference of 40% or less. When the thermal pressure level difference is controlled to 40% or less, it is particularly contributed to the improvement of the repeated use durability of the recording medium. The thermal pressure level difference of the composite laminated recording layer comprising the reversible thermosensitive recording layer and the light-to-heat converting layer, or the composite laminated recording layer comprising the reversible thermosensitive recording layer, the light-to-heat converting layer and the light reflection layer is remarkably small in the recording medium of the present invention as compared with that in the conventional recording medium. It means that the heat resistance and mechanical strength of the layers are excellent. Therefore, even when the laser beam is locally applied to the recording medium to heat it, swelling or contracting of the layers due to the softening phenomenon can be minimized. Accordingly, the reversible thermosensitive recording medium of the present invention can be prevented from deteriorating after repeated image formation and image erasure, and high quality images can be always formed in the recording medium with high contrast.

Even if the heat resistance of only one layer, for example, the reversible thermosensitive layer or the light-to-heat converting layer is improved, the above-mentioned effects are reduced when the heat resistance and mechanical strength of other layers adjacent to the reversible thermosensitive layer or the light-to-heat converting layer are poor. To be more specific, even though one layer is not subjected to thermal deformation, the recording medium is caused to deteriorate when the adjoining layers are thermally deformed when heat is applied to the recording medium. In this case, the decrease of image contrast is inevitable. Therefore, it is preferable that the thermal pressure level difference of the composite laminated recording layer comprising the reversible thermosensitive layer and the light-to-heat converting layer be low, and that the thermal pressure level difference of the composite laminated recording layer comprising the reversible thermosensitive layer, the light-to-heat converting layer and the light reflection layer be low.

The objects of the present invention can also be achieved by a reversible thermosensitive recording medium comprising a support, and a composite laminated recording layer formed on the support, which composite laminated recording layer comprises a reversible thermosensitive recording layer whose transparency or color reversibly changes by the application of heat thereto and which comprises a light-to-heat converting material and has a thermal pressure level difference of 40% or less. In this case, the composite laminated recording layer for use in the above-mentioned recording medium may further comprise a light reflection layer. It is preferable that the thermal pressure level difference of the composite laminated layer comprising the reversible thermosensitive layer and the light reflection layer be as low as 40% or less.

It is apparent that the previously mentioned advantages of the present invention can be obtained more effectively when intermediate layers and other layers adjacent to the reversible thermoseneitive layer, the light-to-heat converting layer or the light reflection layer have high heat resistance and mechanical strength. When the thermal pressure level difference and the thermal pressure level difference change ratio of the previously mentioned composite laminated recording layer are measured, such intermediate layers and adjoining layers may be included in the composite laminated recording layer.

To obtain the previously mentioned advantages maximumly, the thermal pressure level difference of the composite laminated recording layer comprising the reversible thermosensitive recording layer and the light-to-heat converting layer, or the composite laminated recording layer comprising the reversible thermosensitive recording layer, the light-to-heat converting layer and the light reflection layer, or the composite laminated recording layer comprising the reversible thermosensitive recording layer is controlled to 40% or less, preferably 30% or less, more preferably 25% or less, and further preferably 20% or less.

To effectively decrease the thermal pressure level difference of each layer constituting the recording medium, a resin with a high glass transition temperature or a resin prepared by cross-linking may be used for the layer. It is preferable that the glass transition temperature of the resin for use in the layer be 100° C. or more, more preferably 120° C. or more, and further preferably 140° C. or more. When the crosslinked resin is employed, the resin can be croselinked by the application of heat, ultraviolet (UV) light radiation, or electron beam (EB) radiation.

The light-to-heat converting layer comprises a light-to-heat converting material and a resin.

The light-to-heat converting material for use in the light-to-heat converting layer or the reversible thermosensitive layer is a material capable of absorbing light and generating heat.

Specific examples of the inorganic light-to-heat converting material for use in the present invention are carbon black; and metals or semimetals such as Ge, Bi, In, Te, Se and Cr and alloys thereof. Finely-divided particles of the above-mentioned inorganic light-to-heat converting material are bound to a resin to form a light-to-heat converting layer.

As the organic light-to-heat converting material, a variety of dyes can be appropriately selected depending on the wavelength of light to be absorbed. For instance, a near-infrared-rays-absorbing dye having an absorption intensity in a range of 700 to 900 nm can be used as the light-to-heat converting material when the semiconductor laser beam is employed as the light source. Specific examples of the organic light-to-heat converting material for use in the present invention include a cyanine dye, a quinone dye, a quinoline derivative of indonaphthol, a phenylenediamine nickel complex and a phthalocyanine dye. Such organic light-to-heat converting materials are dispersed in the form of particles or molecules in the resin in the light-to-heat converting layer.

Of the above-mentioned light-to-heat converting materials, organic materials which show transparency to the visible light are preferable, and the near-infrared-rays-absorbing dyes are more preferable.

Any resin that can satisfy the previously mentioned conditions of the thermal pressure level difference may be employed for the light-to-heat converting layer.

Examples of the resin for use in the light-to-heat converting layer are phenolic resin, urea resin, melamine resin, unsaturated polyester resin, epoxy resin, silicone resin, urethane resin, acrylic resin, polyvinyl chloride, chlorinated polyvinyl chloride, polyvinylidene chloride, saturated polyester, polyethylene, polypropylene, polystyrene, polymethacrylate, polyamide, polyvinyl pyrrolidone, natural rubber, polyacrolein, polycarbonate, and copolymers comprising a monomer constituting the above-mentioned compounds.

It is preferable that the above-mentioned resins for use in the light-to-heat converting layer be crosslinked, as previously mentioned. Those resins can be crosslinked by the application of heat, ultraviolet light radiation, or electron beam radiation, using a crosslinking agent when necessary.

When the crosslinking is carried out, a monomer having vinyl group, hydroxyl group or carboxyl group may be added to the above-mentioned resin to induce copolymerization, thereby facilitating the crosslinking.

The crosslinking agent for use in the present invention includes non-functional monomers and functional monomers.

Specific examples of the non-functional monomer are as follows:

(1) methyl methacrylate (MMA),
(2) ethyl methacrylate (EMA),
(3) n-butyl methacrylate (BMA),
(4) i-butyl methacrylate (IBMA),
(5) t-butyl methacrylate (TBMA),
(6) 2-ethylhexyl methacrylate (EHMA),
(7) lauryl methacrylate (LMA),
(8) alkyl methacrylate (SLMA),
(9) tridecyl methacrylate (TDMA),
(10) stearyl methacrylate (SMA),
(11) cyclohexyl methacrylate (CHMA), and
(12) benzyl methacrylate (BZMA).

Specific examples of the mono-functional monomer are as follows:

(13) methacrylic acid (MMA),
(14) 2-hydroxyethyl methacrylate (HEMA),
(15) 2-hydroxypropyl methacrylate (HPMA),
(16) dimethylaminoethyl methacrylate (DMMA),
(17) dimethylaminoethyl methylchloride salt methacrylate (DMCMA),

(18) diethylaminoethyl methacrylate (DEMA),
(19) glycidyl methacrylate (GMA),
(20) tetrahydrofurfuryl methacrylate (THFMA),
(21) allyl methacrylate (AMA),
(22) ethylene glycol dimethacrylate (EDMA),
(23) triethylone glycol dimethacrylate (3EDMA),
(24) tetraethylene glycol dimethacrylate (4EDMA),
(25) 1,3-butylene glycol dimethacrylate (BDMA),
(26) 1,6-hexanediol dimethacrylate (HXMA),
(27) trimethylolpropane trimethacrylate (TMPMA),
(28) 2-ethoxyethyl methacrylate (ETMA),
(29) 2-ethylhexyl acrylate,
(30) phenoxyethyl acrylate,
(31) 2-ethoxyethyl acrylate,
(32) 2-ethoxyethoxyethyl acrylate,
(33) 2-hydroxyethyl acrylate,
(34) 2-hydroxypropyl acrylate,
(35) dicyclopentenyloxy ethyl acrylate,
(36) N-vinyl pyrrolidone, and
(37) vinyl acetate.

Specific examples of the di-functional monomer are as follows:

(38) 1,4-butanediol acrylate,
(39) 1,6-hexanediol diacrylate,

(40) 1,9-nonanediol diacrylate,
(41) neopentyl glycol diacrylate,
(42) tetraethylene glycol diacrylate,
(43) tripropylene glycol diacrylate,

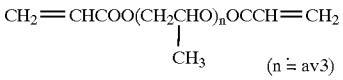

(n ≒ av3)

(44) tripropylene glycol diacrylate,

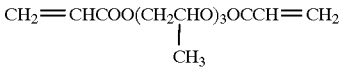

(45) polypropylene glycol diacrylate,

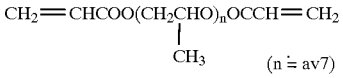

(n ≒ av7)

(46) bisphenol A. EO adduct diacrylate,

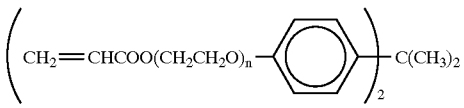

(n ≒ 2)

(47) glycerin methacrylate acrylate,

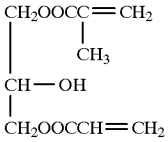

(48) diacrylate with 2-mole adduct of propylene oxide of neopentyl glycol,
(49) diethylene glycol diacrylate,
(50) polyethylene glycol (400) diacrylate,
(51) diacrylate of the ester of hydroxypivalic acid and neopentyl glycol,
(52) 2,2-bis(4-acryloxy.diethoxyphenyl)propane,
(53) diacrylate of neopentyl glycol adipate,

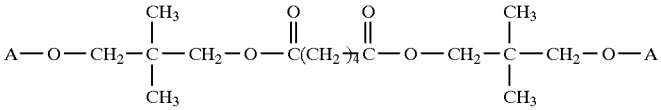

wherein A is

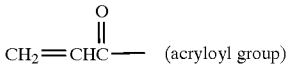

(acryloyl group)

(54) diacrylate of ∈-caprolactone adduct of neopentyl glycol hydroxypivalate,

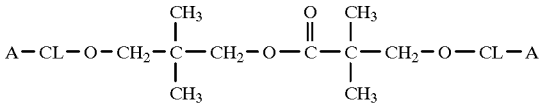

wherein CL is

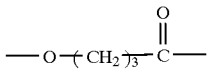

(6-caprolactone)

(55) diacrylate of ∈-caprolactone adduct of neopentyl glycol hydroxypivalate,

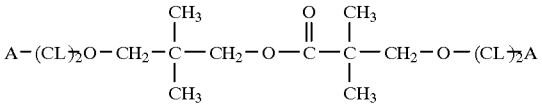

(56) 2-(2-hydroxy-1,1-dimethylethyl)-5-hydroxymethyl-5-ethyl-1,3-dioxanediacrylate,

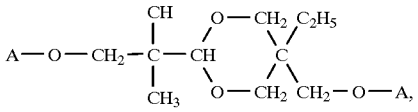

(57) tricyclodecanedimethylol diacrylate,

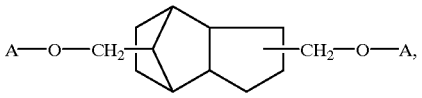

(58) ∈-caprolactone adduct of tricyclodecanedimethylol diacrylate, and

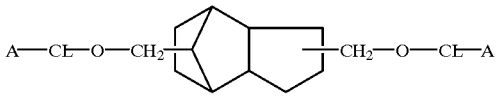

(59) diacrylate of diglycidyl ether of 1,6-hexanediol.

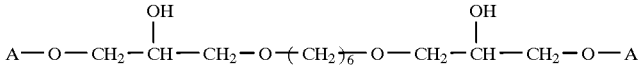

Specific examples of the polyfunctional monomer are as follows:

(60) trimethylolpropane triacrylate,

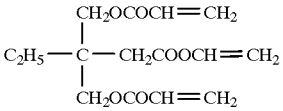

(61) pentaerythritol triacrylate,

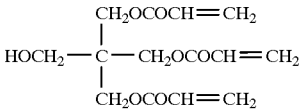

(62) glycerin PO-adduct triacrylate,

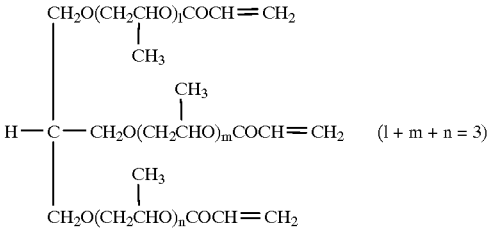

(63) trisacryloyloxyethyl phosphate, $(CH_2{=}CHCOOCH_2CH_2O)_3PO$

(64) pentaerythritol tetraacrylate,

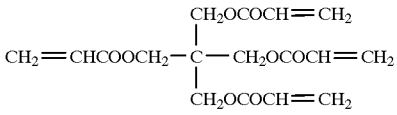

(65) triacrylate with 3-mole adduct of propylene oxide of trimethylolpropane,

(66) glycerylpropoxy triacrylate,

(67) dipentaerythritol.polyacrylate

(68) polyacrylate of caprolactone adduct of dipentaerythritol,

(69) propionic acid.dipentaerythritol triacrylate,

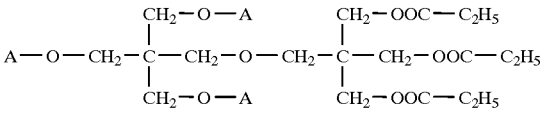

(70) hydroxypivalaldehyde-modified dimethylolpropine triacrylate,

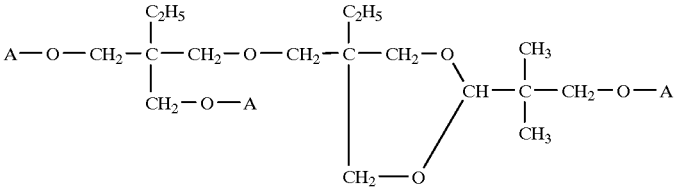

(71) tetraacrylate of propionic acid.dipentaerythritol,

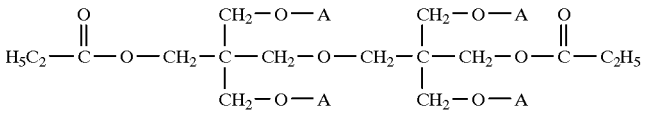

(72) ditrimethylolpropane tetraacrylate,

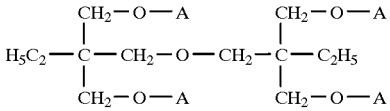

(73) pentaacrylate of dipentaerythritol propionate,

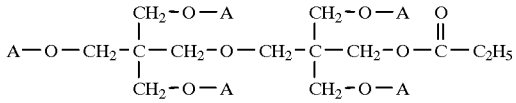

(74) dipentaerythritol hexaacrylate (DPHA), and

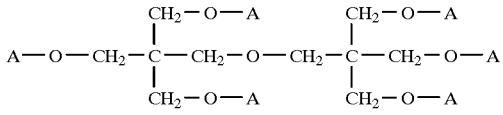

(75) ∈-caprolactone adduct of DPHA,

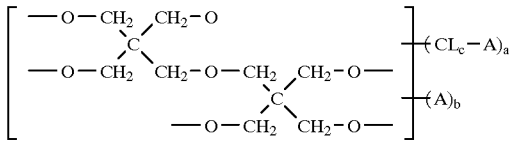

(DPCA-20)

a=2, b=4, c=1

(DPCA-30)

a=3, b=3, c=1

(DPCA-60)

a=6, c=1

(DPCA-120)

a=6, c=2

An example of the oligomer is as follows:

(76) bisphenol A—diepoxyacrylic acid adduct.

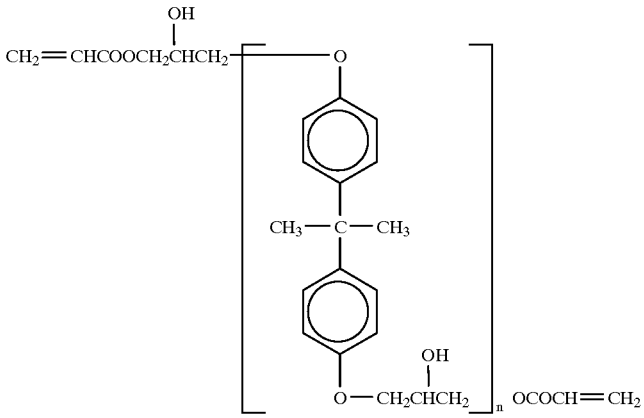

(n ≒ 1.2)

These crosslinking agents can be used alone or in combination. It is preferable that the amount of such a crosslinking agent to be added be in a range of 0.001 to 1.0 parts by weight, more preferably in a range of 0.01 to 0.5 parts by weight, to 1 part by weight of the resin.

In order to increase the crosslinking efficiency by minimizing the amount of such a crosslinking agent added, the functional monomers are better than the non-functional monomers, and the polyfunctional monomers are better than the monofunctional monomers.

When the crosslinking of the resin for use in the light-to-heat converting layer is performed by ultraviolet radiation, the following crosslinking agents, photopolymerization initiators and photopolymerization promoters can be employed, although the crosslinking agents, photopolymerization initiators and photopolymerization promoters for use in the present invention are not limited to them.

More specifically, the crosslinking agents for use in the ultraviolet radiation can be roughly classified into photopolymerizable prepolymers and photopolymerizable monomers.

As the photopolymerizable monomers, the previously mentioned mono-functional monomers and polyfunctional monomers can be employed.

As the photopolymerizable prepolymers, for instance, polyester acrylate, polyurethane acrylate, epoxy acrylate, polyether acrylate, oligoacrylate, alkyd acrylate, and polyol acrylate can be employed.

These crosslinking agents can be used alone or in combination. It is preferable that the amount of such a crosslinking agent to be added be in a range of 0.001 to 1.0 parts by weight, more preferably in a range of 0.01 to 0.5 parts by weight, to 1 part by weight of the resin.

The photopolymerization initiators can be roughly classified into radical reaction type initiators and ionic reaction type initiators. The radical reaction type initiators can be further classified into photocleavage type initiators and hydrogen-pulling type initiators.

Specific examples of the photopolymerization initiator for use in the present invention are as follows:

1. Benzoin ethers:
   Isobutyl bonzoin ether

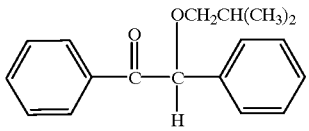

Isopropyl benzoin ether

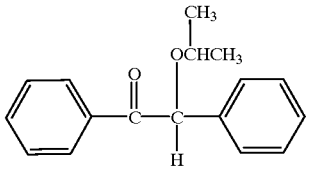

Benzoin ethyl ether

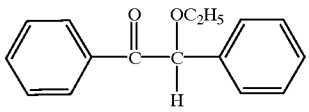

Benzoin methyl ether

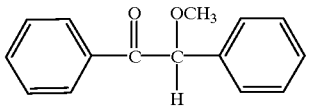

2. α-acyloxime ester:
   1-phenyl-1,2-propane-dion-2-(o-ethoxy-carbonyl)oxime

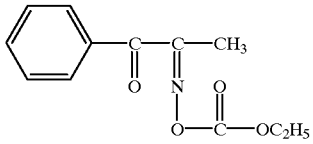

3. Benzyl ketals:
   2,2-dimethoxy-2-phenyl-acetophenone

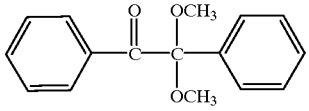

-continued

Benzyl

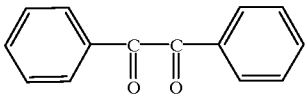

Hydroxycyclohexyl phenyl ketone

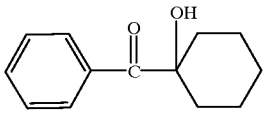

These photopolymerization initiators can be used alone or in combination. It is preferable to employ such an initiator in an amount of 0.005 to 1.0 parts by weight, more preferably in an amount of 0.01 to 0.5 parts by weight, to 1 part of any of the previously mentioned crosslinking agents.

Photopolymerization promoters have a hardening-rate-increasing effect on the hydrogen-pulling type photopolymerization initiators such as benzophenone type and thioxanthone type initiators. There are aromatic tertiary amine type photopolymerization promoters and aliphatic amine type photopolymerization promotors.

Specific examples of such photopolymerization initiators are as follows:

Isoamyl p-dimethylaminobenzoate

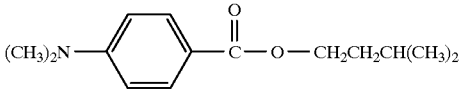

Ethyl p-dimetylaminobenzoate

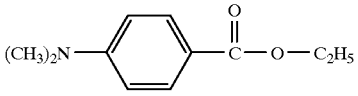

These photopolymerization promotors can be used alone or in combination. It is preferable to employ such a photopolymerization promotor in an amount of 0.1 to 5 parts by weight, more preferably in an amount of 0.3 to 3 parts by weight, to 1 part by weight of the photopolymerization initiator.

An ultraviolet light radiation apparatus for use in the present invention is composed of a light source, a radiation unit, a power source, a cooling unit, and a transportation unit. As the light source, a mercury lamp, a metal halide lamp, a gallium lamp, a mercury xenon lamp, or a flash lamp may be employed. However any light source can be employed as long as it has a light emitting spectrum corresponding to the ultraviolet absorption wavelength for the previously mentioned photopolymerization initiators and photopolymerization promoters.

As to the conditions for ultraviolet light radiation, the lamp output and transportation speed may be determined in accordance with the radiation energy necessary for crosslinking the resin to be crosslinked.

In the present invention, the following is a particularly effective electron beam radiation method for crosslinking the resin for use in the layer of the reversible thermosensitive recording medium of the present invention.

Generally, EB (electron beam) radiation apparatus can be classified into a scan beam EB radiation apparatus and an area beam EB radiation apparatus. An appropriate EB radiation apparatus is chosen in accordance with the desired radiation area, exposure and other factors.

The EB radiation conditions can be determined by the following formula in accordance with the necessary exposure of the resin to be crosslinked to electron beam, with the current, radiation width and transportation speed being taken into consideration:

$$D=(\Delta E/\Delta R)\cdot\eta\cdot I/(W\cdot V)$$

where D: Necessary exposure to electron beam (Mrad)

ΔE/ΔR: Average energy loss

η: Efficiency

I: Current (mA)

W: Radiation width (cm)

V: Transportation speed (cm/s)

For industrial purpose, the above formula is simplified as D·V=K·I/W, and the apparatus rating is indicated by Mrad·m/min.

The current rating is selected in such a manner that about 20 to 30 mA is for an experimental apparatus, about 50 to 100 mA is for a pilot apparatus and about 100 to 500 mA is for an industrial apparatus.

The light-to-heat converting layer for use in the present invention can be fabricated by using a resin which is obtained in such a manner that the previously mentioned functional monomer or oligomer is crosslinked by the EB radiation, or the functional monomer or oligomer is crosslinked with the addition of the photopolymerization initiator by the UV radiation.

The thickness of the light-to-heat converting layer is preferably in a range of 0.1 to 5 μm, more preferably in a range of 0.2 to 3 μm.

The inventors of the present invention have investigated the mechanism as to why the image density and contrast are lowered during the repeated image formation and image erasure in a conventional reversible thermosensitive recording medium comprising a reversible thermosensitive layer in which an organic low-molecular-weight material is dispersed in a matrix resin. More specifically, when the image formation and image erasure are carried out by the application of a laser beam to the recording medium, the following phenomenon is observed.

Before the application of the laser beam to the reversible thermosensitive recording medium comprising the reversible thermosensitive recording layer in which the particles of the organic low-molecular-weight material are dispersed in the matrix resin, or when the number of the application of the laser beam thereto for the image formation or image erasure is a few, such a distortion of the reversible thermosensitive recording layer that changes the state of the presence of the components that constitute the recording layer is so slight, that the particles of the organic low-molecular-weight material are uniformly dispersed within the recording layer.

As will be explained later, the distribution of the particles of the organic low-molecular-weight material can be maintained uniform in the reversible thermosensitive recording layer of the reversible thermosensitive recording medium of the present invention even though image formation and image erasure are repeated.

In the above-mentioned conventional reversible thermosensitive recording medium, however, when the laser beam is applied to the reversible thermosensitive recording medium, the center of the laser-beam-applied portion is heated to a temperature higher than needed because of Gauss distribution of the laser beam. The temperature of such a center of the laser-beam-applied portion becomes much higher than the softening point of the matrix resin for use in the reversible thermosensitive layer. As a result, the resin for use in the reversible thermosensitive layer induces vigorous thermal vibration, and therefore, the molecules of the melted organic low-molecular-weight material pass through the gap between the molecules of the resin. Thus, the resin is separated from the organic low-molecular weight material in the reversible thermosensitive layer, and the particles of the organic low-molecular-weight material begin to aggregate. Finally, the aggregated particles are further caused to aggregate to form aggregated particles with a maximum particle size. When the organic low-molecular-weight material is in such a state, it is almost impossible to perform image formation in the reversible thermosensitive recording medium. This is a so-called deterioration state. It is considered that such a state brings about the lowering of image density when the reversible thermosensitive recording medium is used repeatedly for image formation and image erasure.

The temperature range in which the reversible thermosensitive recording medium can assume a transparent state becomes narrow with time in proportion to the change of the hardening degree of the resin. To clarify the reason for this phenomenon, the mechanism of the change in transparency of the reversible thermosensitive recording medium will now be explained, using a reversible thermosensitive recording medium comprising a reversible thermosensitive recording layer in which the organic low-molecular-weight material is dispersed in the matrix resin.

When the reversible thermosensitive recording layer is transparent, the particles of the organic low-molecular-weight materiel are dispersed in the matrix resin in close contact with the matrix resin. In other words, there is no gap between the particles of the organic low-molecular-weight material and the matrix resin. Furthermore, there is no gap within each particle of the organic low-molecular-weight material. Therefore, light which enters one side of the reversible thermosensitive recording layer passes through the recording layer and emits from the other side of the recording layer, without being scattered, so that the reversible thermosensitive recording layer looks transparent.

When the reversible thermosensitive recording layer is milky white, the particles of the organic low-molecular-weight material are composed of fine crystals of the organic low-molecular-weight material, there are gaps at the interface between the crystals of the organic low-molecular-weight material and/or at the interface between the crystals of the organic low-molecular-weight material and the matrix resin, so that the light which enters one side of the reversible thermosensitive recording layer is scattered at the interface between the gap and the crystal of the organic low-molecular-weight material and at the interface between the gap and the matrix resin. As a result, the reversible thermosensitive recording layer looks milky white.

Figure 11:
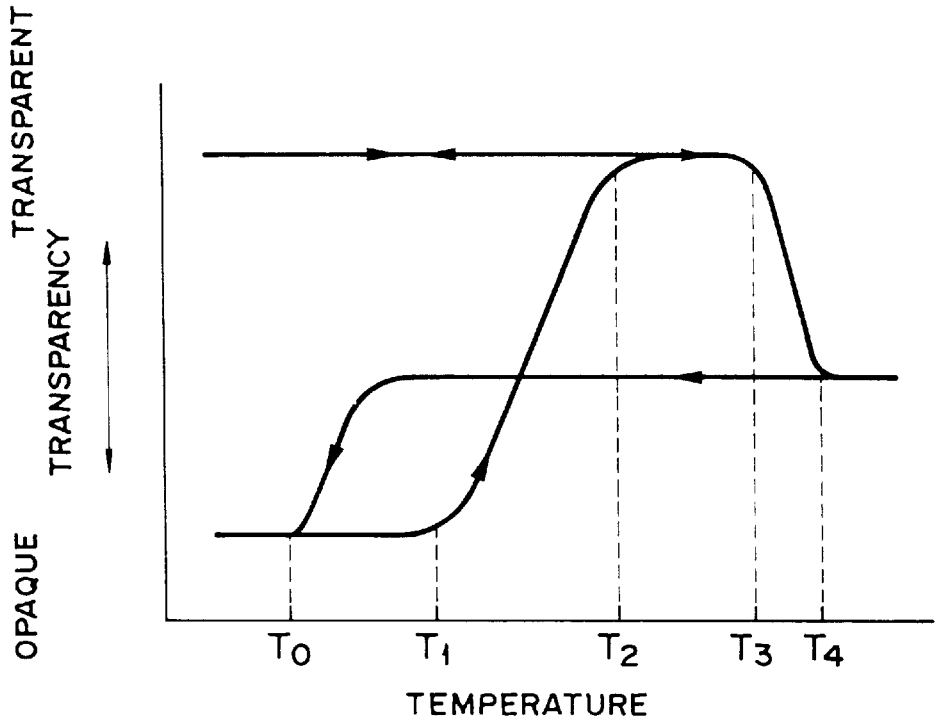
FIG. 11 is a graph showing the relationship between the transparency of a reversible thermosensitive recording layer of the reversible thermoensitive recording medium of the present invention and the temperature thereof.

FIG. 11 is a diagram showing the changes in the transparency of the reversible thermosensitive recording layer (hereinafter referred to as the recording layer) comprising as the main components the matrix resin and the particles of the organic low-molecular-weight material which are dispersed in the matrix resin.

It is supposed that the recording layer is in a milky white opaque state at room temperature $T_0$ or below.

When the temperature of the recording layer is raised by the application of heat thereto, the recording layer gradually begins to become transparent at temperature $T_1$. The recording layer becomes transparent when heated to a temperature in a range of $T_2$ to $T_3$. Even when the temperature of the recording layer in such a transparent state is decreased back to room temperature $T_0$ or below, the transparent state is maintained. This is because when the temperature of the recording layer reaches a temperature near $T_1$, the matrix resin begins to soften. With the progress of softening of the resin, the resin tends to contract, so that the gaps at the interface between the matrix resin and the particles of the organic low-molecular-weight material, and the gaps within the particles of the low-molecular-weight material are decreased. Therefore, the transparency of the recording layer is gradually increased. When the temperature of the recording layer reaches $T_2$ to $T_3$, the organic low-molecular-weight material is in a half-melted state, so that the remaining gaps are filled with the organic low-molecular-weight material. As a result, the recording layer becomes transparent. The recording layer in such a transparent state, however, still contains seed crystals of the organic low-molecular-weight material. When the recording layer in such a transparent state is cooled, the organic low-molecular-weight material crystallizes while it is still at a relatively high temperature, and the matrix resin is in a softened state at the relatively high temperature. When the recording layer is further cooled, the changes in the volume of the matrix resin follow the changes in the volume of the organic low-molecular-weight material in accordance with the crystallization, without forming the gaps therebetween, so that the transparent state is maintained even when the recording layer is cooled.

When the recording layer at a temperature in the range of $T_2$ to $T_3$ is heated to temperature $T_4$ or more, the recording layer assumes a semi-transparent state with a transparency between the maximum transparent state of the recording layer and the maximum opaque state thereof.

When the temperature of the recording layer in such a semi-transparent state is decreased, the recording layer assumes the initial milky white state again, without assuming any transparent state during the cooling process.

This is because the organic low-molecular weight material is completely melted when heated to temperature $T_4$ or above, and when the temperature of the melted organic low-molecular-weight material is decreased, the organic low-molecular-weight material is supercooled and crystallizes at a temperature slightly higher than temperature $T_0$. It is considered that, in this case, the matrix resin cannot follow up the changes in the volume of the organic low-molecular-weight material caused by the crystallization thereof, so that gaps are formed between the matrix resin and the organic low-molecular-weight material, and the recording layer assumes the initial milky white state.

The temperature—transparency changes curves shown in FIG. 11 are representative examples, and therefore, such curves are changeable depending upon the materials employed in the recording layer.

Thus, the softening point of the matrix resin and the deformation behavior of the matrix resin when heated to a temperature above the softening point thereof are important factors for the changes of the transparency of the recording layer.

As mentioned previously, when the hardening degree of the matrix resin for use in the recording layer is increased, the softening point of the matrix resin is also increased, and at the same time, the def ormation behavior of the matrix resin when heated to a temperature above the softening point thereof is changed. It is considered that in a conventional reversible thermosensitive recording medium, the decrease of the transparent temperature range of the recording layer with time during repeated use thereof is closely related to the properties of the matrix resin for use in the recording layer thereof.

Such decrease of the transparent temperature range of the recording layer can be effectively prevented when a composite laminated recording layer comprising the light-to-heat converting layer and the reversible thermosensitive recording layer, a composite laminated recording layer comprising the light-to-heat converting layer, the reversible thermosensitive recording layer and the light reflection layer, a composite laminated recording layer comprising the reversible thermosensitive recording layer and the light reflection layer, or the reversible thermosensitive recording layer has a thermal pressure level difference change ratio of 70% or less.

Since the thermal pressure level difference change ratio of the reversible thermosensitive recording layer or the composite laminated recording layer comprising the recording layer is remarkably small, it is considered that there are substantially no changes in the physical properties of the layers with time, so that the transparent temperature range of the reversible thermosensitive recording layer is not varied, and the width of the transparent temperature range is not decreased, whereby the image erasure characteristics of the reversible thermosensitive recording layer are stabilized.

For obtaining the above-mentioned effect, it is desirable that the change ratio of the thermal pressure level difference be 70% or less, preferably 50% or less, more preferably 45% or less, further preferably 40% or less.

In order to obtain the above-mentioned change ratio of the thermal pressure level difference of 70% or less, the matrix resin for use in the reversible thermosensitive recording layer plays a very important part. Namely, it is necessary that the matrix resin employed in the reversible thermosensitive recording layer maintain a certain hardness when the matrix resin is heated to high temperature. Specific preferable examples of a resin to be used as such a matrix resin include a resin having high softening temperature, a resin comprising a main-chain resin component having high softening temperature and a side-chain resin component having low-temperature softening point, and a crosslinked resin. In particular, it is preferable to employ the crosslinked resin for use in the reversible thermosensitive recording layer.

The resin contained in the reversible thermosensitive recording layer can be crosslinked by the application of heat, ultraviolet light radiation and electron beam radiation. For this purpose, ultraviolet light radiation and electron beam radiation are preferable, and of these two radiation methods, electron beam radiation is more preferable.

The reasons why the crosslinking method by electron beam radiation is excellent are as follows.

The significant differences between the crosslinking of resin by electron beam radiation (hereinafter referred to as EB crosslinking) and the crosslinking of resin by ultraviolet light radiation (hereinafter referred to as UV crosslinking) are as follows:

In UV crosslinking, a photopolymerization initiator and a photosensitizer are necessary. The resins for UV crosslinking are mostly limited to resins having transparency. In contrast to this, in EB crosslinking, the concentration of radicals is so high that the crosslinking reaction proceeds rapidly, so that the polymerization is terminated instantly. Furthermore, EB radiation can provide more energy than UV radiation can so that the reversible thermosensitive recording layer can be made thicker than that for UV radiation.

Furthermore, as mentioned above, in UV crosslinking, a photopolymerization initiator and a photosensitizer are necessary, so that when the crosslinking reaction has been completed, the additives remain in the reversible thermosensitive recording layer and there may be the risk that these additives have adverse effects on the image formation performance, image erasure performance, and repeated use durability of the reversible thermosensitive recording layer.

The significant differences between EB crosslinking and thermal crosslinking are as follows:

In thermal crosslinking, a catalyst for crosslinking and a promoting agent are required. Even though the catalyst and promoting agent are employed, the speed of crosslinking reaction by thermal croselinking is considerably slower than that of the crosslinking reaction by EB crosslinking. Furthermore, in the case of thermal crosslinking, additives such as the above-mentioned catalyst and promoting agent remain in the reversible thermosensitive recording layer after the crosslinking reaction in the same manner as in UV crosslinking and therefore thermal crosslinking has the same shortcomings as UV crosslinking does. Furthermore, since the above-mentioned catalyst and promoting agent remain in the reversible thermosensitive recording layer, the crosslinking reaction may slightly proceed after the initial crosslinking so that it is possible that the recording characteristics of the reversible thermosensitive recording layer may change with time.

For the above-mentioned reasons, EB radiation is regarded as the most suitable method for crosslinking the resin for use in the reversible thermosensitive recording layer. By employing the EB radiation method, the decrease of image contrast can be prevented, thereby keeping the high image contrast even when high-power energy is applied to the recording layer for recording operation.

The reversible thermosensitive recording layer whose transparency or color reversibly changes by the application of heat thereto for use in the reversible thermosensitive recording medium of the present invention is capable of reversibly causing some visible changes. Generally visible changes can be classified into changes in color and changes in form.

In the present invention, materials which mainly change in color are employed for the reversible thermosensitive recording layer.

The changes in color include changes in transmittance, reflectance, absorption wavelength, and the degree of scattering.

In the reversible thermosensitive recording medium for use in practice, image display is carried out by use of a combination of the above-mentioned changes. More specifically, any reversible thermosensitive recording layers can be used as long as the transparency or color thereof is reversibly changed by the application of heat thereto. A specific example of such a reversible thermosensitive recording layer assumes a first colored state at a first specific temperature which is above room temperature. When this reversible thermosensitive recording layer is heated to a second specific temperature which is above the first specific temperature and then cooled, the reversible thermosensitive recording layer assumes a second colored state.

In particular, reversible thermosensitive recording media which are capable of assuming two respective different colored states at a first specific temperature and at a second specific temperature are preferred in the present invention.

For example, Japanese Laid-Open Patent Application 55-154198 discloses a reversible thermosensitive recording medium which assumes a transparent state at a first specific temperature and a milky white state at a second specific temperature. Japanese Laid-Open Patent Applications 4-224996, 4-247985 and 4-267190 disclose reversible thermosensitive recording media which assume a colored state at a second specific temperature and a decolorized state at a first specific temperature. A reversible thermosensitive recording medium disclosed in Japanese Laid-Open Patent Application 3-169590 assumes a milky white state at a first specific temperature and a transparent state at a second specific temperature. Japanese Laid-Open Patent Applications 2-188293 and 2-188294 disclose reversible thermosensitive recording media which assume a colored state with a color such as black, red or blue at a first specific temperature, and a decolorized state at a second specific temperature.

Of the above-mentioned reversible thermosensitive recording layers, the following two types of reversible thermosensitive recording layers are representative:

(1) Reversible thermosensitive recording layers which are capable of reversibly assuming a transparent state and a milky white state, which are referred to as type 1.

(2) Reversible thermosensitive recording layers which are capable of reversibly assuming a colored state by the chemical changes of a dye or the like, which are referred to as type 2.

A representative example of a thermosensitive recording layer of type 1 is a thermosensitive recording layer comprising a matrix resin such as polyester and an organic low-molecular-weight material such as higher alcohol or higher fatty acid which is dispersed in the matrix resin.

A representative example of a thermosensitive recording layer of type 2 is a leuco type thermosensitive recording layer with the reversibility of the color changes being intensified.

As mentioned above, the thermosensitive recording layer of type 1 which is capable of reversibly changing its transparency comprises as the main components a matrix resin and an organic low-molecular weight material which is dispersed in the matrix resin. The reversible thermosensitive recording material of this type has a transparent temperature range as mentioned previously.

The reversible thermosensitive recording medium of the present invention can utilize the reversible changes in the transparency thereof (from a transparent state to a milky white state, and vice versa) as described previously. The difference between the transparent state and the milky white state has been explained with reference to FIG. 11.

In the reversible thermosensitive recording medium of the present invention, it is possible to form milky white images on the transparent background and to form transparent images on the milky white background by selective heat application to the reversible thermosensitive recording layer thereof, and such changes in the transparency of the thermosensitive recording layer can be repeated as desired. When a colored sheet is placed behind such a reversible thermosensitive recording layer, images with a color of the colored sheet can be formed on the milky white background, or milky white images on the background with a color of the colored sheet can be formed.

When images formed on the reversible thermosensitive recording layer are projected on a screen by use of an overhead projector (OHP), the milky white portions on the reversible thermosensitive recording layer correspond to dark portions on the screen, and the transparent portions on the reversible thermosensitive recording layer correspond to light portions on the screen.

It is preferable that the thickness of the reversible thermosensitive recording layer be in a range of 1 to 30 $\mu$m, more preferably in a range of 2 to 20 $\mu$m. When the reversible thermosensitive recording layer is excessively thick, the thermal distribution in the recording layer becomes non-uniform so that it becomes difficult to uniformly make the recording layer transparent. On the other hand, when the reversible thermosensitive recording layer is excessively thin, the milky white opaque degree thereof is decreased so that the contrast of formed images is lowered. The milky white opaque degree of the reversible thermosensitive recording layer can be increased by increasing the amount of a fatty acid to be contained as the organic low-molecular-weight material in the recording layer.

The reversible thermosensitive recording medium comprising the reversible thermosensitive recording layer of type 1 can be fabricated by providing the reversible thermosensitive recording layer on a support by the following methods. The reversible thermosensitive recording layer can be made in the form of a sheet without using the support as the case may be.

(1) A matrix resin and an organic low-molecular-weight material are dissolved in a solvent. This solution is coated on a support. The solvent of the coated solution is then evaporated to form a film-shaped layer or sheet, and the film-shaped layer or sheet is simultaneously crosslinked on the support. The crosslinking may be performed after the formation of the film-shaped layer or sheet.

(2) A matrix resin is dissolved in a solvent in which only the matrix resin is soluble. An organic low-molecular-weight material is pulverized by various methods and dispersed in the above matrix resin solution. The above dispersion is then coated on a support. The solvent of the coated dispersion is then evaporated to form a film-shaped layer or sheet, and the film-shaped layer or sheet is simultaneously crosslinked on the support. The crosslinking may be performed after the formation of the film-shaped layer or sheet.

(3) A matrix resin and an organic low-molecular-weight material are melted with the application of heat thereto without using a solvent. The thus melted mixture is formed into a film or sheet and cooled. The thus formed film or sheet is then crosslinked.

As the solvents for forming a reversible thermosensitive recording layer or a reversible thermosensitive recording medium, varieties of solvents can be employed in accordance with the kinds of matrix resin and organic low-molecular-weight material to be employed. Specific examples of such solvents include tetrahydrofuran, methyl ethyl ketone, methyl isobutyl ketone, chloroform, carbon tetrachloride, ethanol, toluene, and benzene.

The organic low-molecular-weight material is present in a dispersed state in the form of finely-divided particles in the reversible thermosensitive recording layer not only when the reversible thermosensitive recording layer is formed by coating the above-mentioned dispersion, but also when the reversible thermosensitive recording layer is formed by coating the above-mentioned solution.

In the present invention, as the matrix resin for the reversible thermosensitive recording layer of the reversible thermosensitive recording medium, a resin that can be formed into a film layer or sheet and has excellent transparency and stable mechanical strength is preferable.

Such a resin may comprise at least one resin component selected from the group consisting of polyvinyl chloride, chlorinated polyvinyl chloride, polyvinylidene chloride, saturated polyester, polyethylene, polypropylene, polystyrene, polymethacrylate, polyamide, polyvinyl pyrrolidone, natural rubber, polyacrolein, and polycarbonate; or may be a copolymer comprising any of the above-mentioned resin components. In addition, polyacrylate, polyacrylamide, polysiloxane, polyvinyl alcohol and a copolymer comprising a monomer constituting the above-mentioned polymers can be employed.

More specifically, as the above-mentioned resin, the following resins can be employed: polyvinyl chloride; vinyl chloride copolymers such as vinyl chloride—vinyl acetate copolymer, vinyl chloride—vinyl acetate—vinyl alcohol copolymer, vinyl chloride—vinyl acetate—maleic acid copolymer, and vinyl chloride—acrylate copolymer; polyvinylidene chloride; vinylidene chloride copolymers such as vinylidene chloride—vinyl chloride copolymer, and vinylidene chloride—acrylonitrile copolymer; polymethacrylate; and mothacrylate copolymer.

In the case where vinyl chloride copolymer is employed as the matrix resin, it is preferable that the average polymerization degree (p) be 300 or more, more preferably 600 or more, and the weight ratio of the vinyl chloride unit to a copolymerizable unit be in a range of 90/10 to 60/40, more preferably in a range of 85/15 to 65/35.

It is preferable that the softening initiation temperature of a coated film of the reversible thermosensitive recording layer be in a range of 30 to 120° C., more preferably in a range of 40 to 100° C. The softening initiation temperature of the reversible thermosensitive recording layer may be obtained by thermomechanical analysis (TMA). To be more specific, a load is applied to the coated film of the recording layer to keep the coated film under tension, and the temperature at which the coated film begins to stretch may be measured. Alternatively, the softening initiation temperature may be obtained by measuring the glass transition temperature by a differential scanning calorimeter (DSC).

It is required that the organic low-molecular-weight material for use in the present invention can be formed in the shape of particles in the reversible thermosensitive recording layer. It is preferable that the organic low-molecular-weight material have a melting point in a range of about 30 to 200° C., more preferably in a range of about 50 to 150° C.

Specific examples of the organic low-molecular-weight material for use in the present invention are alkanols; alkane diols; halogenated alkanols or halogenated alkane diols; alkylamines; alkanes; alkenes; alkynes; halogenated alkanes; halogenated alkenes; halogenated alkynes; cycloalkanes; cycloalkenes; cycloalkynes; saturated or unsaturated monocarboxylic acids, or saturated or unsaturated dicarboxylic acids, and esters, amides and ammonium salts thereof; saturated or unsaturated halogenated fatty acids and esters, amides and ammonium salts thereof; arylcarboxylic acids, and esters, amides and ammonium salts thereof; halogenated arylcarboxylic acids, and esters, amides and ammonium salts thereof; thioalcohols; thiocarboxylic acids, and esters, amines and ammonium salts thereof; and carboxylic acid esters of thioalcohol. These materials can be used alone or in combination.

It is preferable that the number of carbon atoms of the above-mentioned organic low-molecular-weight material be in a range of 10 to 60, more preferably in a range of 10 to 38, furthermore preferably in a range of 10 to 30. Part of the alcohol groups in the esters may be saturated or unsaturated, and further may be substituted by a halogen. In any case, it is preferable that the organic low-molecular-weight material have at least one atom selected from the group consisting of oxygen, nitrogen, sulfur and a halogen in its molecule. More specifically, it is preferable that the organic low-molecular-weight material comprise, for instance, —OH, —COOH, —CONH, —COOR, —NH, —$NH_2$, —S—, —S—S—, —O— or a halogen atom.

In the present invention, it is preferable to use a composite material comprising an organic low-molecular-weight material having a low melting point and an organic low-molecular-weight material having a high melting point as the above-mentioned organic low-molecular-weight material, since the transparent temperature range of the reversible thermosensitive recording layer can be increased by use of such a composite material as the organic low-molecular-weight material. It is preferable that the difference in the melting point between the low-melting point organic low-molecular-weight material and the high-melting point organic low-molecular weight material be 20° C. or more, more preferably 30° C. or more, most preferably 40° C. or more.

It is preferable that the low-melting point organic low-molecular-weight material have a melting point in a range of 40° C. to 100° C., more preferably in a range of 50° C. to 80° C., and that the high-melting point organic low-molecular-weight material have a melting point in a range of 100° C. to 200° C., more preferably in a range of 110° C. to 180° C.

As the low-melting point organic low-molecular-weight material for use in the present invention, a fatty acid ester, a dibasic acid ester, a polyhydric alcohol di-fatty acid ester, which will be explained in detail later, are preferable. These low-melting point organic low-molecular-weight materials can be used alone or in combination.

The above-mentioned fatty acid ester for use in the present invention is characterized in that the fatty acid ester has a melting point lower than that of the corresponding fatty acid having the same number of carbon atoms as that of the fatty acid ester, which is in an associated state of the two molecules thereof, and includes more carbon atoms than the fatty acid having the same melting point as that of the fatty acid ester.

It is considered that the deterioration of the reversible thermosensitive recording layer during repeated image formation and image erasure by the application of a laser beam is caused by the changes in the dispersion state of the organic low-molecular-weight material. It is also considered that such changes in the dispersion state of the organic low-molecular-weight material are caused by the matrix resin and the organic low-molecular-weight material becoming compatible (soluble in each other) during the application of heat to the reversible thermosensitive recording layer. The compatibility between the matrix resin and the organic low-molecular-weight material is decreased as the number of carbon atoms in the organic low-molecular-weight material is increased. Therefore it is considered that as the compatibility between the matrix resin and the organic low-molecular-weight material is decreased, the deterioration of the reversible thermosensitive recording layer during repeated image formation and image erasure is reduced. Furthermore, there is the tendency that the milky white opaqueness of the reversible thermosensitive recording layer is increased as the number of carbon atoms of the organic low-molecular-weight material is increased.

For these reasons, it is considered that the milky white opaqueness, image contrast and repeated use durability of the reversible thermosensitive recording layer can be improved by using such a fatty acid ester as the organic low-molecular-weight material to be dispersed in the matrix resin in comparison with the case where a fatty acid having the same melting point as that of the fatty acid ester is used as the organic low-molecular-weight material to be dispersed.

By using such a fatty acid ester in combination with the high-melting point organic low-molecular-weight material, the transparent temperature range of the reversible thermosensitive recording layer can be broadened, and the image erasure performance thereof can be improved. Thus, even if the image erasure performance of the reversible thermosensitive recording layer is changed more or less during the storage of the recording medium, images can still be erased without problems. Because of the above-mentioned particular properties of the organic low-molecular-weight material, the repeated use durability of the thermosensitive recording layer can be improved.

An example of the fatty acid easter for use in the present invention is a fatty acid ester having the following formula (I):

$$R_1—COO—R_2 \quad (I)$$

wherein $R_1$ and $R_2$ are an alkyl group having 10 or more carbon atoms.

It is preferable that the number of carbon atoms of the fatty acid ester be 20 or more, more preferably 25 or more, and further more preferably 30 or more. As the number of carbon atoms of the fatty acid ester is increased, the milky white opaqueness of the reversible thermosensitive recording layer is increased and the repeated use durability thereof is also increased.

It is preferable that the melting point of the above fatty acid ester be 40° C. or more. Such fatty acid esters may be used alone or in combination.

Representative examples of the above-mentioned fatty acid ester are as follows: octadecyl stearate, docosyl stearate, octadecyl behenate, and docosyl behenate.

As the di-basic acid ester, a monoester and a diester, which can be represented by the following formula (II), can be employed:

$$ROOC—(CH_2)_n—COOR' \quad (II)$$

wherein R and R' are a hydrogen atom, or an alkyl group having 1 to 30 carbon atoms, provided that R and R' may be the same or different, but cannot be a hydrogen atom at the same time; and n is an integer of 0 to 40.

In the above di-basic acid ester, it is preferable that the number of carbon atoms of the alkyl group represented by R or R' be 1 to 22, and that n be an integer of 1 to 30, more preferably 2 to 20. It is also preferable that the di-basic acid ester have a melting point of 40° C. or more.

The polyhydric alcohol di-fatty acid ester of the following formula (III) can also be used as the organic low-molocular-weight material in the present invention:

$$CH_3(CH_2)_{m-2}COO(CH_2)_nOOC(CH_2)_{m-2}CH_3 \quad (III)$$

wherein n is an integer of 2 to 40, preferably an integer of 3 to 30, more preferably an integer of 4 to 22; and m is an integer of 2 to 40, preferably an integer of 3 to 30, more preferably an integer of 4 to 22.

Specific examples of the high-melting point organic low-molecular-weight material include aliphatic saturated dicarboxylic acids, ketones having a higher alkyl group, semicarbazone derived from the above-mentioned ketones, and α-phosphonofatty acids, and are not limited to these compounds. These compounds can be used alone or in combination.

Such high-melting point organic low-molecular-weight materials, which have melting points of 100° C. or more will now be described in detail.

Specific examples of the aliphatic dicarboxylic acids having melting points in a range of about 100° C. to 135° C. are as follows: succinic acid, glutaric acid, adipic acid, pimelic acid, suberic acid, azelaic acid, sebacic acid, undecanedioic acid, dodecanedioic acid, tetradecanedioic acid, pentadecanedioic acid, hexadecanedioic acid, heptadecanedioic acid, octadecanedioic acid, nonadecanedioic acid, eicosanedioic acid, heneicosanedioic acid, and docosanedioic acid.

The ketones used as the high-melting point organic low-molecular-weight material have a ketone group and a higher alkyl group as indispensable constituent groups. The ketones may also have an unsubstituted or substituted aromatic ring or heterocyclic ring.

It is preferable that the entire number of carbon atoms contained in such ketones be 16 or more, more preferably 21 or more.

The semicarbazone for use in the present invention is derived from the above-mentioned ketones.

It is preferable that the mixing ratio by weight of the low-melting point organic low-molecular-weight material: the high-melting point organic low-molecular-weight material be in a range of 95:5 to 5:95, more preferably in a range of 90:10 to 10:90, further more preferably in a range of 80:20 to 20:80.

In addition to the above-mentioned low-melting point and high-melting point organic low-molecular-weight materials, other organic low-molecular-weight materials may be used in combination.

Examples of such organic low-molecular-weight materials include higher fatty acids such as lauric acid, dodecanoic acid, myristic acid, pentadecanoic acid, palmitic acid, stearic acid, behanic acid, nonadecanoic acid, arachic acid, and oleic acid.

As mentioned previously, in order to expand the transparent temperature range of the reversible thermosensitive recording layer in the present invention, the above-mentioned organic low-molecular-weight materials may be appropriately used in combination. Alternatively, any of the above-mentioned organic low-molecular-weight materials and other materials having different melting points from the melting points of the above-mentioned organic low-molecular-weight materials may be used in combination. Such materials are disclosed in Japanese Laid-Open Patent Applications 63-39378 and 63-130380, and Japanese Applications 63-14754 and 3-2089, but the materials to be used in combination with the above-mentioned organic low-molecular-weight materials are not limited to the materials proposed in the above references.

It is preferable that the ratio by weight of the organic low-molecular-weight material to the matrix resin which is a resin having a crosslinked structure be in a range of 2:1 to 1:16, more preferably in a range of 1:2 to 1:8.

When the amount of the resin is in the above-mentioned range, a resin film which can hold the organic low-molecular-weight material therein can be appropriately formed, and the reversible thermosensitive recording layer can be made opaque with no difficulty.

In addition to the above-mentioned components, additives such as a surfactant and a plasticizer may be added to the reversible thermosensitive recording layer in order to facilitate the formation of transparent images.

Examples of the plasticizer include phosphoric ester, fatty acid ester, phthalic acid ester, dibasic acid ester, glycol, polyester-based plasticizers, and epoxy plasticizers.

Specific examples of such plasticizers are tributyl phosphate, tri-2-ethylhexyl phosphate, triphenyl phosphate, tricresyl phosphate, butyl oleate, dimethyl phthalate, diethyl phthalate, dibutyl phthalate, diheptyl phthalate, di-n-octyl phthalate, di-2-ethylhexyl phthalate, diisononyl phthalate, dioctyldecyl phthalate, diisodecyl phthalate, butylbenzyl phthalate, dibutyl adipate, di-n-hexyl adipate, di-2-ethylhexyl adipate, di-2-ethylhexyl azelate, dibutyl sebacate, di-2-ethylhexyl sebacate, diethylene glycol dibenzoate, triethylene glycol di-2-ethyl butyrate, methyl acetylricinoleate, butyl acetylricinoleate, butylphthalyl butyl glycolate and tributyl acetylcitrate.

Specific examples of the surfactant and other additives are polyhydric alcohol higher fatty acid esters; polyhydric alcohol higher alkyl ethers; lower olefin oxide adducts of polyhydric alcohol higher fatty acid ester, higher alcohol, higher alkyl phenol, higher alkyl amine of higher fatty acid, amide of higher fatty acid, fat and oil, and propylene glycol; acetylene glycol; sodium, calcium, barium and magnesium salts of higher alkylbenzenesulfonic acid; calcium, barium and magnesium salts of aromatic carboxylic acid, higher aliphatic sulfonic acid, aromatic sulfonic acid, sulfonic monoester, phosphoric monoester and phosphoric diester; lower sulfated oil; long-chain polyalkyl acrylate; acrylic oligomer; long-chain polyalkyl methacrylate; copolymer of long-chain alkyl methacrylate and amine-containing monomer; styrene—maleic anhydride copolymer; and olefin—maleic anhydride copolymer.

The reversible thermosensitive recording medium of the present invention may comprise a reversible thermosensitive recording layer of type 2, as previously mentioned. This type of reversible thermosensitive recording layer, which utilizes a coloring reaction between an electron-donating coloring compound and an electron-accepting compound, will now be explained.

A reversible thermosensitive coloring composition for use in the thermosensitive recording layer of type 2 comprises the electron-donating coloring compound and the electron-accepting compound, and the reversible thermosensitive coloring composition forms an amorphous colored material when the electron-donating coloring compound and the electron-accepting compound are mixedly heated to a fusing temperature and fused by the application of heat thereto. When the amorphous colored material is heated to a temperature lower than the above-mentioned fusing temperature, the electron-accepting compound in the amorphous colored material crystallizes out, so that the colored material is decolorized.

The above-mentioned reversible thermosensitive coloring composition can induce color formation therein instantaneously when heated at a predetermined color development temperature, and the color development state can be maintained at room temperature in a stable condition. When the coloring composition in the color development state is heated at a predetermined temperature lower than the color development temperature, the coloring composition can assume a decolorization state and the decolorization state can also be maintained at room temperature in a stable condition. This peculiar reversible coloring and decolorizing behavior is a surprising phenomenon.

The principle of the formation and erasion of images in a reversible thermosensitive recording layer comprising the above-mentioned reversible thermosensitive coloring composition will now be explained with reference to the graph shown in FIG. 12.

Figure 12:
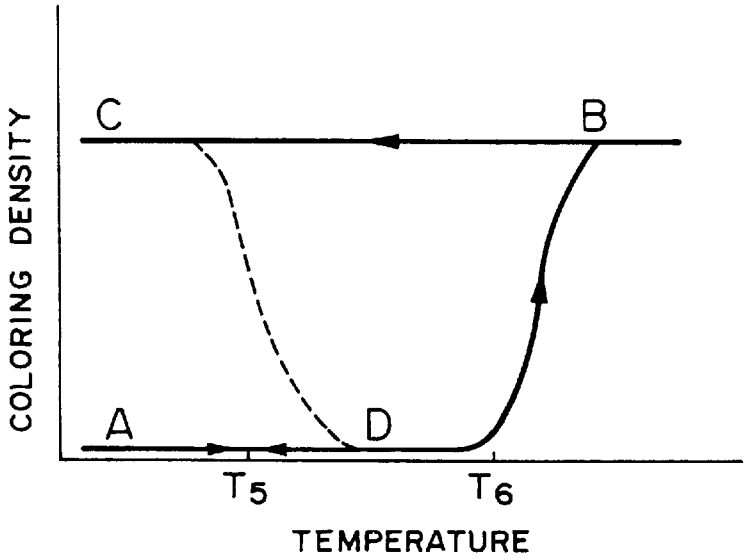
FIG. 12 is a graph showing the relationship between the coloring density of a reversible thermosensitive recording layer of the reversible thermosensitive recording medium of the present invention and the temperature thereof.

In the graph shown in FIG. 12, the coloring density of a colored image is plotted as ordinate and the temperature as abscissa. A solid line indicates the process of image formation in the reversible thermosensitive recording medium by the application of heat thereto; and a dashed line indicates the process of image erasure by the application of heat to the recording medium. The coloring density of a recording medium which is in a complete decolorization condition is indicated by a coloring density A; the coloring density of the recording medium in a saturated color development condition obtained by heating to a temperature $T_6$ or more is indicated by a coloring density B; the coloring density of the recording medium in a saturated color development condition at a temperature $T_5$ or less is indicated by a coloring density C; and the coloring density of the recording medium in a decolorization condition obtained by heating to a temperature between $T_5$ and $T_6$ is indicated by a coloring density D.

The reversible thermosensitive recording medium according to the present invention is in a decolorization condition with a coloring density A at a temperature $T_5$ or less. By heating the recording medium to a temperature $T_6$ or more using heat-application means such as a thermal head, the density increases to the coloring density B, thereby forming a colored image in the recording medium. The coloring density B of the image thus recorded in the recording medium can be maintained as the coloring density C even though the temperature is decreased to $T_5$ or less along with the solid line. This means that the image once recorded in the recording medium has the memory characteristics.

To erase the colored image recorded in the recording medium, the recording medium in the color development state may be heated to a temperature between the temperatures $T_5$ and $T_6$, which is lower than the color development temperature. Thus, the recording medium reaches a decolorization state with the coloring density D. Such a decolorization state of the recording medium can be maintained when the temperature is decreased to $T_5$ or less. In other words, the coloring density D in the decolorization state can be maintained as the coloring density A.

The process of the image formation in the recording medium proceeds through the solid line A-B-C and the recorded image is maintained with the coloring density C; and the process of the image erasure proceeds through the dashed line C-D-A, and the decolorization state of the recording medium can be maintained with the coloring density A. The behavior characteristics of such image formation and image erasure in the recording medium have a reversibility, so that the image formation and erasure can be repeated many times.

In the reversible thermosensitive coloring composition, the coloring agent and the color developer are indispensable components, and a binder resin may be contained when necessary. When the coloring agent and the color developer are heated to a coloring temperature and fused, the reversible thermosensitive coloring composition assumes a colored state. When the reversible thermosensitive coloring composition is then heated to a temperature lower than the above-mentioned coloring temperature, the colored state is changed to a decolorized state. These colored state and decolorized state can stably exist at room temperature. This reversible coloring and decolorizing phenomenon is based on the previously mentioned coloring and decolorizing mechanism.

To newly obtain a colored state of the recording medium, it is advantageous that the recording medium be once heated to a temperature of $T_6$ or more and thereafter the recording medium be caused to assume the decolorization state. This is because the particles of the coloring agent and color developer can be returned to the original condition.

In the case of a conventional coloring composition comprising a conventional coloring agent and color developer, for example, a leuco compound having a lactone ring which is a dye precursor widely employed in a conventional thermosensitive recording paper, and a phenolic compound which is capable of inducing a color in the leuco compound, when the composition is heated to mix and fuse the leuco compound and the phenolic compound, the leuco compound assumes a colored state by the lactone ring being opened. In this colored state, the leuco compound and the phenolic compound are mutually dissolved to form an amorphous state. This colored amorphous state is stable at room temperature. However, even if this composition in the colored amorphous state is again heated, the phenolic compound does not crystallize and therefore is not separated from the leuco compound, so that the lactone ring closure does not occur and therefore the composition does not assume a decolorized state.

In the reversible thermosensitive recording medium of the present invention, when the coloring composition comprising the coloring agent and the color developer is heated to the coloring temperature to mix and fuse the coloring agent and the color developer, the composition assumes an amorphous colored state, which is stable at room temperature in the same manner as in the above-mentioned composition comprising the leuco compound and the phenolic compound. However, in the present invention, it is considered that when the composition in the amorphous colored state is heated to a temperature lower than the coloring temperature, at which the coloring agent and the color developer are not fused, the color developer crystallizes. Thus, the bonding between the color developer and the coloring agent in a compatible condition cannot be maintained, and the color developer is separated from the coloring agent, so that the coloring agent is decolorized since the color developer cannot accept electrons from the coloring agent.

The peculiar coloring and decolorizing behavior of the above-mentioned reversible thermosensitive coloring composition is related to the following factors: mutual solubility of the coloring agent and the color developer when they are fused by the application of heat thereto, the intensities of the actions of the coloring agent and the color developer in the colored state, the solubility of the color developer in the coloring agent, and the crystallizability of the color developer. In principle, however, any combination of a coloring agent and a color developer can be employed for the coloring composition for use in the present invention as long as they can become amorphous when fused by the application of heat thereto and the crystallization of the color developer can take place when heated to a temperature lower than the coloring temperature. Furthermore, such a combination of the coloring agent and the color developer can be easily recognized by thermal analysis because such a combination indicates endothermic change due to the fusion and exothermic change due to the crystallization.

The above-mentioned reversible thermosensitive coloring composition may further comprise a third material such as a binder resin when necessary. It has been confirmed that the above-mentioned reversible coloring and decolorizing behavior can be maintained even when a polymeric material is contained in the coloring composition. As the binder resin for use in the coloring composition, the same resins as employed in the reversible thermosensitive recording layer of the previously mentioned recording medium of type 1 are usable.

In the above-mentioned reversible thermosensitive coloring composition for use in the present invention, the decolorization thereof is caused by the separation of the color developer from the coloring agent because of the crystallization of the color developer. In order to obtain a reversible thermosensitive coloring composition with excellent decolorization effect, the choice of a suitable color developer is extremely important.

Preferable examples of the color developer for use in the present invention are as follows, but the color developer for use in the present invention is not limited to these examples:

(1) Organic phosphoric acid compound of the following formula:

$$R_1—PO(OH)_2 \quad (1)$$

wherein $R_1$ is a straight or branched alkyl or alkenyl group having 8 to 30 carbon atoms.

Specific examples of the organic phosphoric acid compound of formula (1) are octylphosphonic acid, nonylphosphonic acid, decylphosphonic acid, dodecylphosphonic acid, tetradecylphosphonic acid, hexadecylphosphonic acid, octadecylphosphonic acid, eicosylphosphonic acid, docosylphosphonic acid, and tetracosylphosphonic acid.

(2) Organic acid of the following formula, having a hydroxyl group at the α-position thereof:

$$R_2—CH(OH)COOH \quad (2)$$

wherein $R_2$ is a straight or branched alkyl or alkenyl group having 6 to 28 carbon atoms.

Specific examples of the organic acid of formula (2) are α-hydroxyoctanoic acid, α-hydroxydodecanoic acid, α-hydroxytetradecanoic acid, α-hydroxyhexadecanoic acid, α-hydroxyoctadecanoic acid, α-hydroxypentadecanoic acid, α-hydroxyeicosanoic acid, and α-hydroxydocosanoic acid, The coloring agent for use in the above-mentioned reversible thermosensitive coloring composition is an electron-accepting compound, which is a colorless or light-colored dye precursor. Examples of the coloring agent include triphenylmethane phthalide compounds, fluoran compounds, phenothiazine compounds, leuco auramine compounds, rhodaminelactam compounds, spiropyran compounds and indolinophthalide compounds, but the coloring agent for use in the present invention is not limited to these compounds.

The light reflection layer for use in the reversible thermosensitive recording medium of the present invention is generally a deposited film made of a metal with a high thermal conductivity, such as Al, Sn, Ag, Au, An or Ni.

It is preferable that the thickness of the light reflection layer be in a range of 100 to 2,000 Å, more preferably in a range of 200 to 1,000 Å.

The glossiness of the light reflection layer is preferably 200% or more, more preferably 300% or more, and further preferably 500% or more when measured in accordance with the method described in ASTM D 523 at an angle of 60°.

In the present invention, it is preferable to provide the light reflection layer which comprises a plurality of separate light reflection layer portions in order to obtain high image contrast.

Figure 13:
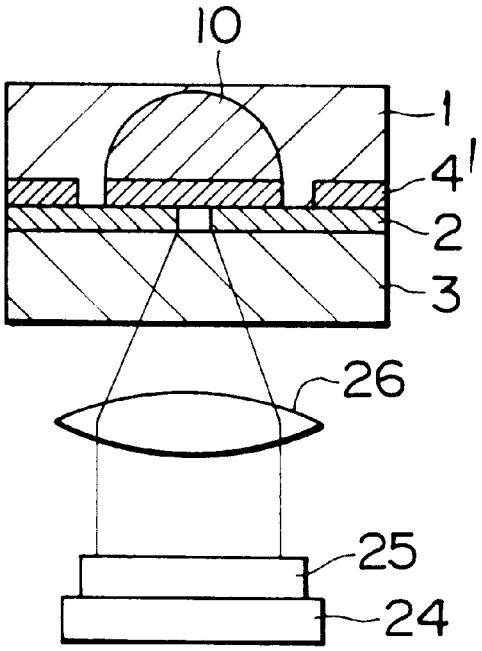
FIG. 13(*a*) is a schematic diagram showing that the recording is carried out in a reversible thermosensitive recording medium of the present invention whose light reflection layer comprises a plurality of separate light reflection layer portions.
Figure 13:
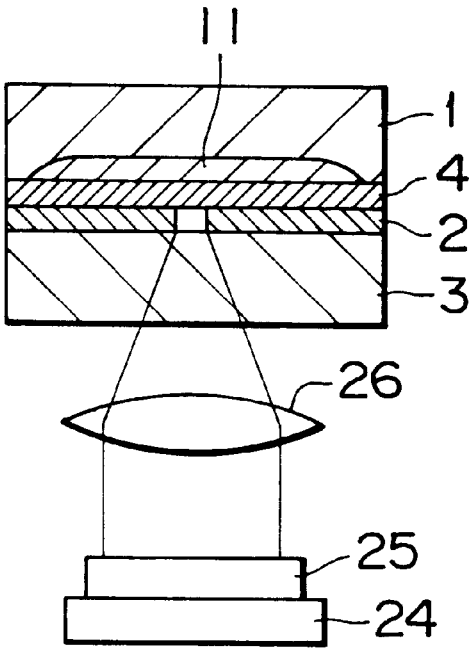

FIGS. 13(*a*) and 13(*b*) are schematic cross-sectional views of reversible thermosensitive recording media, in explanation of the action of a light reflection layer comprising a plurality of separate light reflection layer portions.

A reversible thermosensitive recording medium as shown in FIG. 13(*a*) has the same structure as that illustrated in FIG. 4. A laser beam 25 emitted from a laser beam light source 24 is caused to pass through an object lens 26 and focused on a portion in a light-to-heat converting layer 2 of the recording medium. The portion of the light-to-heat converting layer 2 is heated by the focused light, and the generating heat energy is transmitted to one separate light reflection layer portion of a light reflection layer 4', and then, conducted to a reversible thermosensitive recording layer 1. By heating the reversible thermosensitive recording layer 1 in such a procedure, images can be formed therein.

In FIG. 13(*a*), reference numeral 10 indicates a heated portion which is capable of inducing the change of transparency or color thereof. This heated portion 10 is sufficiently expanded in the thickness direction of the recording layer 1.

In contrast to this, a reversible thermosensitive recording medium as shown in FIG. 13(*b*) comprises a light reflection layer 4 which is continuously provided on a light-to-heat converting layer 2. When the thermal energy generating in a portion of the light-to-heat converting layer 2 is transmitted through the light reflection layer 4, the thermal energy is horizontally dispersed in the light reflection layer 4. As a result, the reversible thermosensitive recording layer 1 cannot be heated to a sufficient temperature. Consequently, a heated portion 11 of which transparency or color is caused to induce some change is formed only in a part of the reversible thermosensitive recording layer 1 in the thickness direction thereof. Therefore, the image contrast is decreased.

It is preferable that the thermal conductivity of the heat-insulating layer 5 as shown in FIG. 1(*f*) or FIG. 2(*e*) be lower than that of the light reflection layer 4. The same resins as used in the light-to-heat converting layer or the reversible thermosensitive recording layer can be used for the formation of the heat-insulating layer. The thickness of the heat-insulating layer is preferably in a range of 0.1 to 5 μm, and more preferably in a range of 0.3 to 2.0 μm.

As shown in FIG. 5, a protective layer may be provided on the reversible thermosensitive recording layer. Examples of the material for such a protective layer having a thickness of 0.1 to 10 μm are a silicone rubber and a silicone resin as disclosed in Japanese Laid-Open Patent Application 63-221097, a polysiloxane graft polymer as disclosed in Japanese Patent Application 62-152550, and an ultraviolet curing resin and an electron beam curing resin as disclosed in Japanese Patent Application 63-310600.

When a protective layer is formed by use of any of the above-mentioned materials, a solvent is used for coating the protective layer. It is preferable that a solvent in which the resin and the organic low-molecular-weight material for use in the reversible thermosensitive recording layer are not soluble or slightly soluble be employed for the formation of the protective layer.

Specific examples of such a solvent include n-hexane, methyl alcohol, ethyl alcohol, and isopropyl alcohol. In view of the cost, alcohol solvents are preferable.

It is possible to cure the protective layer simultaneously with the crosslinking of the resin in the light-to-heat converting layer and the resin in the reversible thermosensitive recording layer. In this case, the light-to-heat converting layer and the reversible thermosensitive recording layer are formed on a support by the previously mentioned method, and a protective layer formation liquid is coated on the top layer and dried. Thereafter, the coated protective layer, the light-to-heat converting layer and the recording layer may be cured by using the previously mentioned electron beam radiation apparatus, or the previously mentioned ultraviolet light radiation apparatus.

Furthermore, it is also possible to apply an adhesive layer to the back surface of the support, opposite to the recording layer side in order to use the reversible thermosensitive recording medium as a reversible thermosensitive recording label sheet. Such a reversible thermosensitive recording label sheet can be stuck on a base sheet or plate. Examples of such a base sheet or plate are polyvinyl chloride cards for credit cards, IC cards, optical cards, ID cards, paper, film, synthetic paper, boarding pass, and commuter's pass. The base sheet or plate is not limited to the above-mentioned examples.

In the case where the support is, for example, an aluminum-deposited layer which has poor adhesiveness to a resin, an adhesive layer may be interposed between the support and the reversible thermosensitive recording layer as disclosed in Japanese Laid-Open Patent Application 3-7377.

According to the present invention, there is provided a method of forming images in a reversible thermosensitive recording medium and erasing the images therefrom comprising the steps of preheating the reversible thermosensitive recording medium to a predetermined temperature, and applying a laser beam to the recording medium to form images and/or erase the images.

It is desirable that the reversible thermosensitive recording medium of the present invention be preheated to a predetermined temperature which is higher than room temperature. This is because the change in sensitivity of the recording medium caused by the variation of ambient temperature can be prevented, so that clear images can be produced constantly and the obtained images can be uniformly erased. In addition, it is possible to increase the sensitivity of the recording medium.

Figure 14:
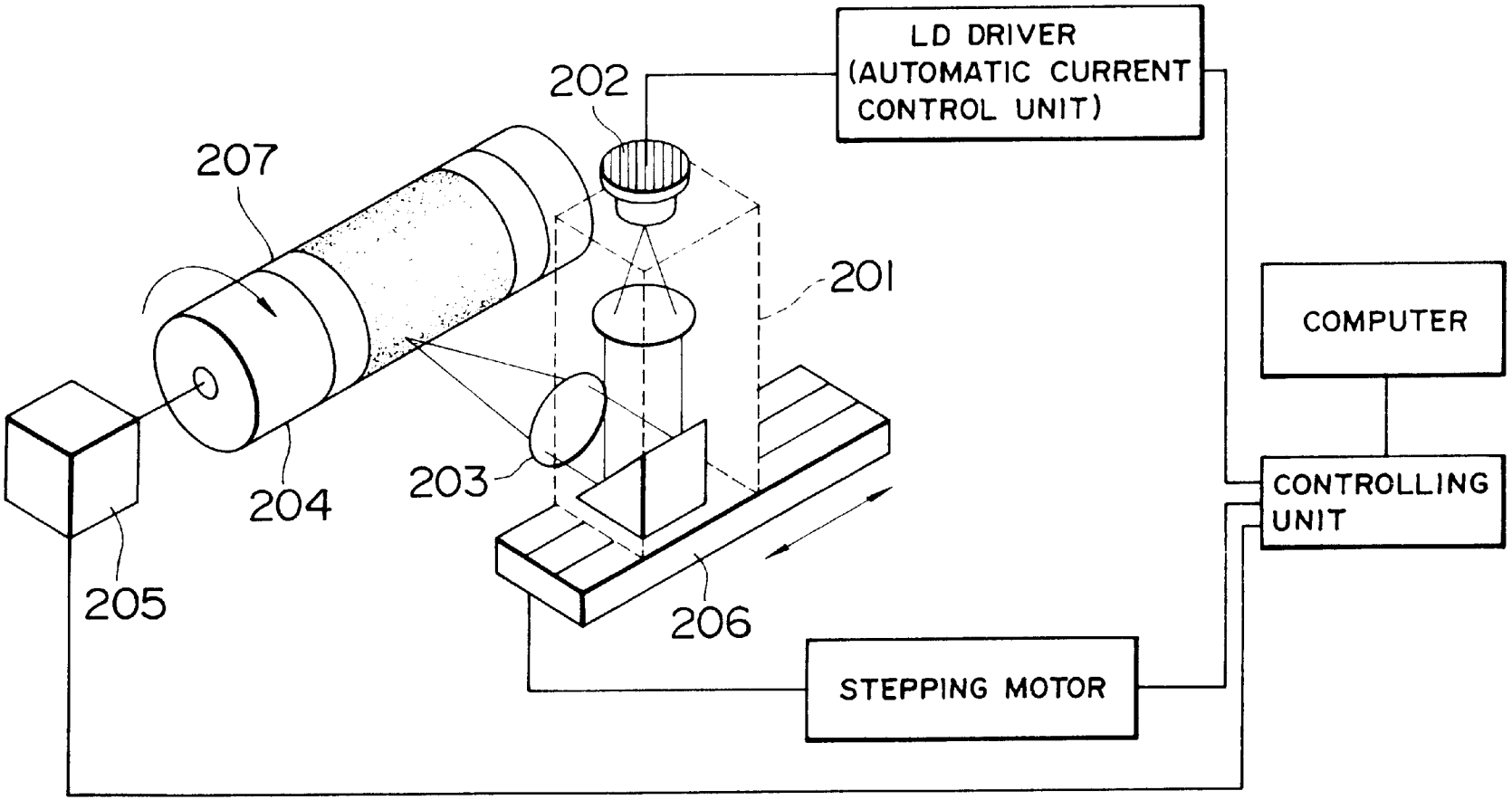
FIG. 14 is a schematic diagram of one example of an image recording apparatus using a laser beam for the reversible thermosensitive recording medium of the present invention.

To be more specific, an image recording apparatus as shown in FIG. 14 can be used for recording information in the reversible thermosensitive recording medium of the present invention by the application of a laser beam thereto.

The image recording apparatus as shown in FIG. 14 comprises an optical head unit 201 comprising a laser diode 202 as a light source of semiconductor laser beam and a focus lens 203 for controlling the application of the laser beam to a reversible thermosensitive recording medium 207 of the present invention; a main-scanning recording unit comprising a drum 204 and a DC motor 205 for rotating the drum 204; and a sub-scanning recording unit comprising a transportation stage 206 for transporting the optical head unit 201 in the sub-scanning direction.

The actions of the semiconductor laser beam based on image recording signals, the rotation of the drum 204, and the transportation of the stage 206 are controlled by a microcomputer.

A heater is provided in the drum 204 of the recording apparatus, so that the drum 204 and the recording medium 207 can be preheated to a predetermined temperature.

Such a preheating system can be applied to the previously mentioned reversible thermosensitive recording media capable of assuming two respective different colored states at a first specific temperature and at a second specific temperature. For instance, when a reversible thermosensitive recording medium capable of forming images therein at a second specific temperature and erasing the images therefrom at a first specific temperature is subjected to image forming and erasing operation, the temperature of the heater in the drum 204 may be preset to the above-mentioned first specific temperature, so that the images can be erased simultaneously. Thereafter, by selectively heating the recording medium to the second specific temperature by the application of a laser beam thereto, images can be formed therein.

When the reversible thermosensitive recording medium comprises a reversible thermosensitive recording layer whose transparency reversibly changes by the application of heat thereto, and which comprises a matrix resin and an organic low-molecular-weight material dispersed in the form of particles in the matrix resin, the preheating temperature of the recording medium may be set to a temperature higher than the minimum crystallization temperature of the organic low-molecular-weight material.

If the preheating temperature is lower than the minimum crystallization temperature of the organic low-molecular-weight material, sufficient white opaqueness of the recording layer cannot be obtained. The reason for this is considered that after the recording medium is heated by the application of a laser beam thereto, the recording medium is rapidly cooled, and therefore, glass transition of the matrix resin does not take place smoothly due to the crystallization of the organic low-molecular-weight material.

The minimum crystallization temperature of the organic low-molecular-weight material for use in the reversible thermosensitive recording layer can be measured by peeling the reversible thermosensitive recording layer off the recording medium, and heating the recording layer to a temperature where the organic low-molecular-weight material is completely fused, and thereafter cooling by use of a differential scanning calorimeter (DSC). The temperature at which an exothermic curve is terminated, that is, the temperature at which the crystallization of the organic low-molecular-weight material is completed, is referred to as the minimum crystallization temperature of the organic low-molecular-weight material. In this case, the measurement by use of the DSC is carried out under the condition that the coolina rate is 2° C./min or less.

Furthermore, according to the present invention, images can be effectively formed in the reversible thermosensitive recording medium and erased therefrom by the application of a laser beam thereto, with the application conditions of the laser beam being controlled. Namely, there is provided a method of forming images in a reversible thermosensitive recording medium and erasing the images therefrom by the application of a laser beam to the recording medium under control of at least one factor selected from the group consisting of the radiation time of the laser beam, the amount of the applied laser beam, the focusing of the applied laser beam, and the intensity distribution of the applied laser beam. By such control of the conditions of applied laser beam, the temperature of the reversible thermosensitive recording medium can be set to the specific first or second temperature. In addition, the cooling rate of the recording medium after the heating step can be changed, so that the image formation or erasure can be carried out on the entire surface or a part of the recording medium.

The features of this invention will become apparent in the course of the following description of exemplary embodiments, which are given for illustration of the invention and are not intended to be limiting thereof.

EXAMPLE 1

[Formation of light-to-heat converting layer]

The following components were mixed and dissolved:

| | Parts by Weight |
|---|---|
| Ti-phthalocyanine | 10 |
| Vinyl chloride — vinyl acetate — phosphoric ester copolymer (Trademark "Denka Vinyl #1000P" made by Denki Kagaku Kogyo Kabushiki Kaisha) | 10 |
| ϵ-caprolactone adduct of dipentaerythritol hexaacrylate "DPCA-30" (Trademark), made by Nippon Kayaku Co., Ltd. | 1.5 |
| Methyl ethyl ketone | 30 |
| Toluene | 30 |

The thus obtained coating liquid was coated on a commercially available transparent polyester film with a thickness of about 100 μm "Lumirror T-60" (Trademark), made by Toray Industries, Inc., and dried at 120° C. for 5 minutes, so that a light-to-heat converting layer with a thickness of about 1 μm was provided on the polyester film support.

The above formed light-to-heat converting layer was subjected to electron beam radiation by use of a commercially available area beam type electron beam radiation apparatus (Trademark "EBC-200-AA2" made by Nisshin High Voltage Co., Ltd.) under the conditions that the electron beam exposure was 30 Mrad.

[Formation of reversible thermosensitive recording layer]

A coating liquid for the formation of a reversible thermosensitive recording layer with the following formulation was coated on the light-to-heat converting layer, dried at 130° C. for 5 minutes, whereby a reversible thermosensitive recording layer with a thickness of about 8 μm was formed on the light-to-heat converting layer:

| | Parts by Weight |
|---|---|
| Behenic acid (Trademark "NAA-22S" made by Nippon Oils & Fats Co., Ltd.) | 5 |
| Eicosanedioic acid (Trademark "SL-20-99" made by Okamura Oil Mill Ltd.) | 5 |
| Vinyl chloride — vinyl acetate copolymer (Trademark "No. 20-1497", vinyl chloride (80%) and vinyl acetate (20%), average degree of polymerization = 500, made by Kanegafuchi Chemical Industry Co., Ltd.) | 40 |
| ϵ-caprolactone adduct of dipentaerythritol hexaacrylate "DPCA-30" (Trademark), made by Nippon Kayaku Co., Ltd. | 6 |
| THF | 150 |
| Toluene | 15 |

The above formed reversible thermosensitive recording layer was subjected to electron beam radiation by use of the same electron beam radiation apparatus under the same conditions as in the curing of the light-to-heat converting layer.

A coating liquid for the formation of a protective layer with the following formulation was coated on the reversible thermosensitive recording layer by a wire bar, dried under the application of heat thereto, and cured by ultraviolet light using an 80 W/cm ultraviolet lamp, whereby a protective layer with a thickness of about 2 μm was formed on the reversible thermosensitive recording layer.

| | Parts by Weight |
|---|---|
| 75% solution of butyl acetate of urethaneacrylate type ultraviolet-curing resin (Trademark "Unidic C7-157" made by Dainippon Ink & Chemicals, Incorporated) | 10 |
| IPA | 10 |

Thus, a reversible thermosensitive recording medium No. 1 of the present invention was fabricated.

EXAMPLE 2

The procedure for fabrication of the reversible thermosensitive recording medium No. 1 in Example 1 was repeated except that 6 parts by weight of the commercially available ∈-caprolactone adduct of dipentaerythritol hexaacrylate "DPCA-30" (Trademark), made by Nippon Kayaku Co., Ltd. used in the coating liquid for the formation of the reversible thermosensitive recording layer in Example 1 were replaced by 2 parts by weight of a commercially available trimethylolpropane triacrylate "TMP3A" (Trademark), made by Osaka Organic Chemical Industry Ltd., and that the electron beam exposure in the electron beam radiation conducted to the reversible thermosensitive recording layer in Example 1 was changed to 15 Mrad.

Thus, a reversible thermosensitive recording medium No. 2 of the present invention was fabricated.

EXAMPLE 3

The procedure for fabrication of the reversible thermosensitive recording medium No. 2 in Example 2 was repeated except that the amount of the commercially available trimethylolpropane triacrylate "TMP3A" (Trademark), made by Osaka Organic Chemical Industry Ltd. used in the coating liquid for the formation of the reversible thermosensitive recording layer in Example 2 was changed from 2 parts by weight to one part by weight.

Thus, a reversible thermosensitive recording medium No. 3 of the present invention was fabricated.

EXAMPLE 4

The procedure for fabrication of the reversible thermosensitive recording medium No. 1 in Example 1 was repeated except that a light reflection layer with a thickness of about 600 Å was interposed between the transparent polyester film support and the light-to-heat converting layer as employed in Example 1 in such a manner that aluminum was vacuum-deposited on the transparent polyester film.

Thus, a reversible thermosensitive recording medium No. 4 of the present invention was fabricated.

EXAMPLE 5

The procedure for fabrication of the reversible thermosensitive recording medium No. 2 in Example 2 was repeated except that a light reflection layer with a thickness of about 600 Å was interposed between the transparent polyester film support and the light-to-heat converting layer as employed in Example 2 in such a manner that aluminum was vacuum-deposited on the transparent polyester film.

Thus, a reversible thermosensitive recording medium No. 5 of the present invention was fabricated.

EXAMPLE 6

The procedure for fabrication of the reversible thermosensitive recording medium No. 3 in Example 3 was repeated except that a light reflection layer with a thickness of about 600 Å was interposed between the transparent polyester film support and the light-to-heat converting layer as employed in Example 3 in such a manner that aluminum was vacuum-deposited on the transparent polyester film.

Thus, a reversible thermoasensitive recording medium No. 6 of the present invention was fabricated.

EXAMPLE 7

The procedure for fabrication of the reversible thermosensitive recording medium No. 4 in Example 4 was repeated except that the formation of the light-to-heat converting layer in Example 4 was eliminated, and that 2 parts by weight of Ti-phthalocyanine were added to the formulation for the coating liquid of the reversible thermosensitive recording layer employed in Example 4.

Thus, a reversible thermosensitive recording medium No. 7 of the present invention was fabricated.

EXAMPLE 8

The procedure for fabrication of the reversible thermosensitive recording medium No. 6 in Example 6 was repeated except that the formation of the light-to-heat converting layer in Example 6 was eliminated, and that 2 parts by weight of Ti-phthalocyanine were added to the formulation for the coating liquid of the reversible thermosensitive recording layer employed in Example 6.

Thus, a reversible thermosensitive recording medium No. 8 of the present invention was fabricated.

EXAMPLE 9

The same light-to-heat converting layer was provided on the same commercially available transparent polyester film in the same manner as in Example 1.

[Formation of reversible thermosensitive recording layer]

A coating liquid for the formation of a reversible thermosensitive recording layer with the following formulation was coated on the light-to-heat converting layer, dried at 90° C. for 5 minutes, and then cured by the application of heat thereto, whereby a reversible thermosensitive recording layer with a thickness of about 8 μm was formed on the light-to-heat converting layer:

| | Parts by Weight |
|---|---|
| Behenic acid (Trademark "NAA-22S" made by Nippon Oils & Fats Co., Ltd.) | 5 |
| Eicosanedioic acid (Trademark "SL-20-99" made by Okamura Oil Mill Ltd.) | 5 |
| Vinyl chloride — vinyl acetate — vinyl alcohol copolymer (Trademark "S-Lec A", made by Sekisui Chemical Co., Ltd.) | 30 |
| Curing agent: Isocianate (Trademark "Duranate 24A-100", made by Asahi Chemical Industry Co., Ltd.) | 3 |
| Curing accelerator: Triethylene-diamine | 0.3 |
| Toluene | 30 |
| THF | 120 |

Thereafter, the same protective layer with a thickness of about 2 μm was formed on the reversible thermosensitive recording layer as in Example 1.

Thus, a reversible thermosensitive recording medium No. 9 of the present invention was fabricated.

EXAMPLE 10

The procedure for fabrication of the reversible thermosensitive recording medium No. 9 in Example 9 was repeated except that a light reflection layer with a thickness of about 600 Å was interposed between the transparent polyester film support and the light-to-heat converting layer as employed in Example 9 in such a manner that aluminum was vacuum-deposited on the transparent polyester film.

Thus, a reversible thermosensitive recording medium No. 10 of the present invention was fabricated.

EXAMPLE 11

The procedure for fabrication of the reversible thermosensitive recording medium No. 9 in Example 9 was repeated except that the formation of the light-to-heat converting layer in Example 9 was eliminated, and that 2 parts by weight of Ti-phthalocyanine were added to the formulation for the coating liquid of the reversible thermoseneitive recording layer employed in Example 9.

Thus, a reversible thermosensitive recording medium No. 11 of the present invention was fabricated.

EXAMPLE 12

The procedure for fabrication of the reversible thermosensitive recording medium No. 4 in Example 4 was repeated except that the light reflection layer used in Example 4 was changed to separate light reflection square portions, each having an area of about 90 μm square, which were vacuum-deposited on the transparent polyester film support by using a mask at intervals of about 10 μm.

Thus, a reversible thermosensitive recording medium No. 12 of the present invention was fabricated.

EXAMPLE 13

The procedure for fabrication of the reversible thermosensitive recording medium No. 4 in Example 4 was repeated except that the overlaying order of the light reflection layer and the light-to-heat converting layer employed in Example 4 was reversed, whereby a light-to-heat converting layer, a light reflection layer, a reversible thermosensitive recording layer and a protective layer were successively overlaid on the polyester film support.

Thus, a reversible thermosensitive recording medium No. 13 of the present invention was fabricated.

Comparative Example 1

[Formation of light-to-heat converting layer]

A mixture of the following components was dispersed in a ball mill for one hour:

| | Parts by Weight |
|---|---|
| Carbon black | 1 |
| 10% ethanol solution of ethyl cellulose | 50 |

The thus obtained coating liquid was coated on a commercially available transparent polyester film with a thickness of about 100 μm "Lumirror T-60" (Trademark), made by Toray Industries, Inc., and dried, so that a light-to-heat converting layer with a thickness of about 1 μm was provided on the polyester film support.

[Formation of reversible thermosensitive recording layer]

A coating liquid for the formation of a reversible thermosensitive recording layer with the following formulation was coated on the light-to-heat converting layer, dried at 130° C. for 5 minutes, whereby a reversible thermosensitive recording layer with a thickness of about 8 μm was formed on the light-to-heat converting layer:

| | Parts by Weight |
|---|---|
| Behenic acid (Trademark "NAA-22S" made by Nippon Oils & Fats Co., Ltd.) | 5 |
| Eicosanedioic acid (Trademark "SL-20-99" made by Okamura Oil Mill Ltd.) | 5 |
| Vinyl chloride — vinyl acetate | 40 |

-continued

| | Parts by Weight |
|---|---|
| copolymer (Trademark "No. 20-1497", vinyl chloride (80%) and vinyl acetate (20%), average degree of polymerization = 500, made by Kanegafuchi Chemical Industry Co., Ltd.) | |
| THF | 150 |
| Toluene | 15 |

Thereafter, the same protective layer with a thickness of about 2 μm was formed on the reversible thermosensitive recording layer as in Example 1.

Thus, a comparative reversible thermosensitive recording medium No. 1 was fabricated.

Comparative Example 2

The procedure for fabrication of the reversible thermosensitive recording medium No. 1 in Example 1 was repeated except that the ∈-caprolactone adduct of dipentaerythritol hexaacrylate "DPCA-30" (Trademark), made by Nippon Kayaku Co., Ltd. was eliminated from the formulations for the coating liquids of the light-to-heat converting layer and the reversible thermosensitive recording layer employed in Example 1, and that the electron beam radiation conducted to the light-to-heat converting layer and the reversible thermosensitive recording layer in Example 1 was not conducted.

Thus, a comparative reversible thermosensitive recording medium No. 2 was fabricated.

Comparative Example 3

The procedure for fabrication of the reversible thermosensitive recording medium No. 7 in Example 7 was repeated except that the ∈-caprolactone adduct of dipentaerythritol hexaacrylate "DPCA-30" (Trademark), made by Nippon Kayaku Co., Ltd. was eliminated from the formulation for the coating liquid of the reversible thermosensitive recording layer employed in Example 7, and that the electron beam radiation conducted to the reversible thermosensitive recording layer in Example 7 was not conducted.

Thus, a comparative reversible thermosensitive recording medium No. 3 was fabricated.

Comparative Example 4

The procedure for fabrication of the reversible thermosensitive recording medium No. 1 in Example 1 was repeated except that the ∈-caprolactone adduct of dipentaerythritol hexaacrylate "DPCA-30" (Trademark), made by Nippon Kayaku Co., Ltd. was eliminated from the formulation for the coating liquid of the reversible thermosensitive recording layer employed in Example 1, and that the electron beam radiation conducted to the reversible thermosensitive recording layer in Example 1 was not conducted.

Thus, a comparative reversible thermosensitive recording medium No. 4 was fabricated.

Comparative Example 5

The procedure for fabrication of the reversible thermosensitive recording medium No. 4 in Example 4 was repeated except that the ∈-caprolactone adduct of dipentaerythritol hexaacrylate "DPCA-30" (Trademark), made by Nippon Kayaku Co., Ltd. was eliminated from the formulation for the coating liquid of the reversible thermosensitive recording layer employed in Example 4, and that the electron beam radiation conducted to the reversible thermosensitive recording layer in Example 4 was not conducted.

Thus, a comparative reversible thermosensitive recording medium No. 5 was fabricated.

[Durability Test]

The reversible thermosensitive recording media No. 1 to No. 13 of the present invention fabricated in Examples 1 to 13, and comparative reversible thermosensitive recording media No. 1 to No. 5 fabricated in Comparative Examples 1 to 5 were subjected to a durability test by repeating image formation and erasure by use of the image recording apparatus as shown in FIG. 14.

There was employed as the light source a commercially available semiconductor laser of single fundamental mode "SDL7032" (Trademark), made by Sanyo Electric Co., Ltd., with a maximum output of continuous wave of 100 mW and an oscillating wavelength of 830 nm. In this case, the light spot size was about 3 μm.

With heating the drum 204 of the recording apparatus to about 45° C., image formation was carried out by applying the laser beam with an output of 40 mW under the conditions that a pulse with a width of 120 μsec was applied at intervals of 150 μsec. The laser beam was applied to the support side of the recording medium No. 13 obtained in Example 13, while the laser beam was applied to the recording layer side in the case of other recording media.

Image erasure was performed by use of a heat-application roller of about 90° C. Such image formation and erasure was repeated 100 cycles. The densities of a milky white opaque image and a transparent background were measured by Macbeth Reflection Densitometer "RD-914" and the contrast of those densities was obtained after the first cycle of the image formation and erasure, and after the 100 th cycle of the image formation and erasure.

When measuring the densities in the reversible thermosensitive recording media Nos. 1, 2 and 3 of the present invention and the comparative reversible thermosensitive recording medium No. 4, a black sheet (OD: 2.0) was disposed on the back side of each recording medium. The results are shown in Table 1.

TABLE 1

| | 100-cycle Image Formation & Erasure Durability Test | | | | | |
|---|---|---|---|---|---|---|
| | After 1st cycle | | | After 100th cycle | | |
| | Density of milky white image | Density of transparent background | Contrast (*) | Density of milky white image | Density of transparent background | Contrast (*) |
| Ex. 1 | 0.65 | 1.52 | 2.3 | 0.65 | 1.53 | 2.4 |
| Ex. 2 | 0.67 | 1.55 | 2.3 | 0.69 | 1.54 | 2.2 |
| Ex. 3 | 0.71 | 1.60 | 2.3 | 0.71 | 1.60 | 2.3 |
| Ex. 4 | 0.50 | 1.22 | 2.4 | 0.52 | 1.24 | 2.4 |
| Ex. 5 | 0.52 | 1.24 | 2.4 | 0.54 | 1.23 | 2.3 |
| EX. 6 | 0.55 | 1.25 | 2.3 | 0.56 | 1.26 | 2.3 |
| Ex. 7 | 0.54 | 1.25 | 2.3 | 0.55 | 1.27 | 2.3 |
| Ex. 9 | 0.57 | 1.28 | 2.2 | 0.59 | 1.28 | 2.2 |
| Ex. 9 | 0.67 | 1.54 | 2.3 | 0.69 | 1.40 | 2.0 |
| Ex. 10 | 0.55 | 1.24 | 2.3 | 0.59 | 1.09 | 1.8 |
| Ex. 11 | 0.57 | 1.28 | 2.2 | 0.60 | 1.13 | 1.9 |
| Ex. 12 | 0.45 | 1.22 | 2.7 | 0.46 | 1.24 | 2.7 |
| Ex. 13 | 0.32 | 1.12 | 3.5 | 0.32 | 1.13 | 3.5 |
| Comp. Ex. 1 | 1.02 | 1.50 | 1.5 | 1.20 | 1.45 | 1.2 |
| Comp. Ex. 2 | 0.65 | 1.20 | 1.9 | 0.90 | 1.18 | 1.3 |

TABLE 1-continued

| | 100-cycle Image Formation & Erasure Durability Test | | | | | |
|---|---|---|---|---|---|---|
| | After 1st cycle | | | After 100th cycle | | |
| | Density of milky white image | Density of transparent background | Contrast (*) | Density of milky white image | Density of transparent background | Contrast (*) |
| Comp. Ex. 3 | 0.63 | 1.22 | 1.9 | 0.85 | 1.20 | 1.4 |
| Comp. Ex. 4 | 0.61 | 1.55 | 2.3 | 0.91 | 1.40 | 1.6 |
| Comp. Ex. 5 | 0.52 | 1.24 | 2.4 | 0.97 | 1.09 | 1.3 |

(*) Contrast = Density of transparent background/Density of milky white image

[Measurement of Thermal Pressure Level Difference and Thermal Pressure Level Difference Change Ratio]

Samples of the reversible thermosensitive recording media No. 1 to No. 13 of the present invention fabricated in Examples 1 to 13, and the comparative reversible thermosensitive recording media No. 1 to No. 5 prepared in Comparative Examples 1 to 5 were subjected to a thermal pressure application test by use of the thermal pressure application apparatus as shown in FIG. 6 under the conditions that the pressure applied to each sample was 2.5 kg/cm$^2$, the application time was 10 seconds, and the application temperature was 130° C.

By use of the previously mentioned two-dimensional roughness analyzer "Surfcorder AY-41" (Trademark), the recorder "RA-60E" (Trademark), and "Surfcorder SE30K" (Trademark), made by Kosaka Laboratory Co., Ltd., the average thermal pressure level difference ($D_m$) of each sample of the above-mentioned recording media was read, and the initial thermal pressure level difference ($D_I$) thereof was obtained.

In addition, the thermal pressure level difference change ratio ($D_C$) of each sample was calculated from the above obtained initial thermal pressure level difference ($D_I$) and thermal pressure level difference with time ($D_D$) thereof. The results are shown in Tables 2 and 3.

TABLE 2

| | Thermal Pressure Level Difference (%) | | | | |
|---|---|---|---|---|---|
| | A(*) | B(*) | C(*) | D(*) | E(*) |
| Ex. 1 | 11 | — | — | 10 | 12 |
| Ex. 2 | 20 | — | — | 18 | 11 |
| Ex. 3 | 35 | — | — | 36 | 11 |
| Ex. 4 | — | 10 | — | 11 | 11 |
| Ex. 5 | — | 18 | — | 20 | 12 |
| Ex. 6 | — | 36 | — | 38 | 11 |
| Ex. 7 | — | — | 11 | 11 | — |
| Ex. 8 | — | — | 33 | 33 | — |
| Ex. 9 | 30 | — | — | 27 | 11 |
| Ex. 10 | — | 32 | — | 30 | 12 |
| Ex. 11 | — | — | 31 | 29 | 12 |
| Ex. 12 | — | 11 | — | 11 | — |
| Ex. 13 | — | 10 | — | 10 | — |
| Comp. Ex. 1 | 90 | — | — | 93 | 95 |
| Comp. Ex. 2 | — | 80 | — | 90 | 90 |
| Comp. Ex. 3 | — | — | 94 | 95 | 92 |
| Comp. Ex. 4 | 45 | — | — | 90 | 12 |
| Comp. Ex. 5 | — | 47 | — | 85 | 11 |

(*)
A: Composite laminated recording layer comprising the reversible thermosensitive recording layer and light-to-heat converting layer.
B: Composite laminated recording layer comprising the reversible thermosensitive recording layer, light-to-heat converting layer and light reflection layer.
C: Composite laminated recording layer comprising the reversible thermosensitive recording layer and light reflection layer.
D: Reversible thermosensitive recording layer.
E: Light-to-heat converting layer.

TABLE 3

| | Change Ratio of Thermal Pressure Level Difference (%) | | | | |
|---|---|---|---|---|---|
| | A(*) | B(*) | C(*) | D(*) | E(*) |
| Ex. 1 | 25 | — | — | 27 | 22 |
| Ex. 2 | 11 | — | — | 10 | 20 |
| Ex. 3 | 40 | — | — | 50 | 23 |
| Ex. 4 | — | 20 | — | 23 | 21 |
| Ex. 5 | — | 14 | — | 12 | 20 |
| Ex. 6 | — | 35 | — | 44 | 20 |
| Ex. 7 | — | — | 18 | 20 | — |
| Ex. 9 | — | — | 45 | 45 | — |
| Ex. 9 | 84 | — | — | 99 | 24 |
| Ex. 10 | — | 80 | — | 86 | 21 |
| Ex. 11 | — | — | 81 | 88 | 22 |
| Ex. 12 | — | 18 | — | 20 | — |
| Ex. 13 | — | 19 | — | 19 | — |
| Comp. Ex. 1 | 4 | — | — | 4 | 5 |
| Comp. Ex. 2 | — | 3 | — | 4 | 3 |
| Comp. Ex. 3 | — | — | 5 | 9 | 4 |
| Comp. Ex. 4 | 12 | — | — | 10 | 22 |
| Comp. Ex. 5 | — | 15 | — | 11 | 20 |

(*)
A: Composite laminated recording layer comprising the reversible thermosensitive recording layer and light-to-heat converting layer.
B: Composite laminated recording layer comprising the reversible thermosensitive recording layer, light-to-heat converting layer and light reflection layer.
C: Composite laminated recording layer comprising the reversible thermosensitive recording layer and light reflection layer.
D: Reversible thermosensitive recording layer.
E: Light-to-heat converting layer.

EXAMPLE 14

Using the image recording apparatus as shown in FIG. 14, white opaque images were formed in the reversible thermosensitive recording medium No. 1 fabricated in Example 1 in such a manner that the output of the laser beam was set to 40 mW and a pulse with a width of 120 μsec was applied at intervals of 150 μsec.

Thereafter, the laser beam of 30 mW was applied to the previously formed white opaque image portions, with the pulse width being changed to 145 μm. Thus, the white opaque portions were made transparent. Namely, the images formed in the recording medium were erased therefrom by changing the condition of the applied laser beam.

Such image formation and image erasure were alternately repeated 10 times. As a result, clear images were formed in the recording medium and the images thus formed were uniformly erased from the recording medium.

As previously explained, since the composite laminated recording layer comprising the reversible thermosensitive recording layer and the light-to-heat converting layer, the composite laminated recording layer comprising the reversible thermosensitive recording layer, the light-to-heat converting layer and the light reflection layer, the composite laminated recording layer comprising the reversible thermosensitive recording layer and the light reflection layer, the reversible thermosensitive recording layer, or the light-to-heat converting layer has a thermal pressure level difference of 40% or less, the repeated use durability of the recording medium can be improved when image formation and erasure was repeatedly performed.

In addition, when the image formation and erasure is carried Out by application of a laser beam to the recording medium, the recording medium can be prevented from being deformed and can produce high quality images with high contrast, and the sensitivity of the recording medium can be maintained during the repeated use.

Furthermore, the recording medium can be discarded without any problem of environmental pollution.

Japanese Patent Application No. 6-227273 filed Aug. 29, 1994 and Japanese Patent Application filed Aug. 25, 1995 are hereby incorporated by reference.

What is claimed is:

1. A reversible thermosensitive recording medium comprising a support and a composite laminated recording layer formed on said support, said composite laminated recording layer comprising:

(a) a reversible thermosensitive recording layer whose transparency or color reversibly changes by the application of heat thereto, and (b) a light-to-heat converting layer comprising a light-to-heat converting material and a resin, and said composite laminated recording layer having a thermal pressure level difference of 40% or less, wherein the resin in the light-to-heat converting layer is crosslinked with a crosslinking agent selected from the group consisting of non-functional monomers, functional monomers, and mixtures thereof.

2. The reversible thermosensitive recording medium as claimed in claim 1, wherein said composite laminated recording layer has a thermal pressure level difference change ratio of 70% or less.

3. The reversible thermosensitive recording medium as claimed in claim 1, wherein said reversible thermosensitive recording layer has a thermal pressure level difference change ratio of 70% or less.

4. The reversible thermosensitive recording medium as claimed in claim 1, wherein said light-to-heat converting layer has a thermal pressure level difference of 40% or less.

5. The reversible thermosensitive recording medium as claimed in claim 1, wherein said reversible thermosensitive recording layer has a thermal pressure level difference of 40% or less.

6. The reversible thermosensitive recording medium as claimed in claim 1, further comprising a light reflection layer which is provided on the back side of said support, opposite to said composite laminated recording layer side with respect to said support.

7. The reversible thermosensitive recording medium as claimed in claim 1, wherein said composite laminated recording layer further comprises a light reflection layer.

8. The reversible thermosensitive recording medium as claimed in claim 7, wherein said composite laminated recording layer has a thermal pressure level difference change ratio of 70% or less.

9. The reversible thermosensitive recording medium as claimed in claim 7, wherein said reversible thermosensitive recording layer has a thermal pressure level difference change ratio of 70% or less.

10. The reversible thermosensitive recording medium as claimed in claim 7, wherein said light-to-heat converting layer has a thermal pressure level difference of 40% or less.

11. The reversible thermosensitive recording medium as claimed in claim 7, wherein said reversible thermosensitive recording layer has a thermal pressure level difference of 40% or less.

12. The reversible thermosensitive recording medium as claimed in claim 7, wherein said light reflection layer comprises a plurality of separate light reflection layer portions.

13. The reversible thermosensitive recording medium as claimed in claim 1, wherein said reversible thermosensitive recording layer has a softening-initiation temperature in a range of 30 to 120° C.

14. A reversible thermosensitive recording medium comprising:

a support; and a composite laminated recording layer formed on said support, which composite laminated recording layer comprises:

a reversible thermosensitive recording layer whose transparency or color reversibly changes by the application of heat thereto and which comprises a light-to-heat converting material, and has a thermal pressure level difference of 40% or less, wherein the resin in the light-to-heat converting layer is crosslinked with a crosslinking agent selected fiom the group consisting of non-functional monomers, functional monomers, and mixtures thereof.

15. The reversible thermosensitive recording medium as claimed in claim 14, further comprising a light reflection layer which is provided on the back side of said support, opposite to said composite laminated recording layer side with respect to said support.

16. The reversible thermosensitive recording medium as claimed in claim 14, wherein said composite laminated recording layer further comprises a light reflection layer and has a thermal pressure level difference of 40% or less.

17. The reversible thermosensitive recording medium as claimed in claim 16, wherein said light reflection layer comprises a plurality of separate light reflection layer portions.

18. The reversible thermosensitive recording medium as claimed in claim 14, wherein said reversible thermosensitive recording layer has a thermal pressure level difference change ratio of 70% or less.

* * * * *

UNITED STATES PATENT AND TRADEMARK OFFICE

CERTIFICATE OF CORRECTION

PATENT NO. : 5,948,727
DATED : September 7, 1999
INVENTOR(S) : Yoshihiko Hotta et al.

It is certified that error appears in the above-identified patent and that said Letters Patent is hereby corrected as shown below:

Column 1,
Line 49, "63-221097" should read -- 63-221087 --.

Column 3,
Line 43, "lvel" should read -- level --.

Column 11,
Line 55, "croselinked" should read -- crosslinked --.

Column 14,
Line 54, "(6-caprolactone)" should read -- ϵ-caprolactone --.

Column 15,
Lines 1-5, "

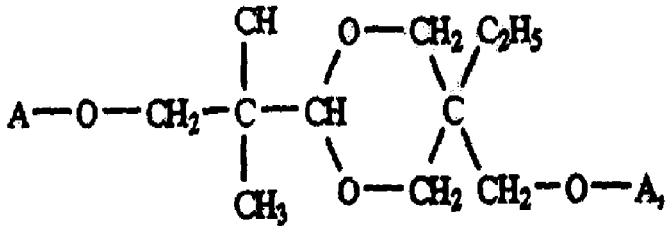

"

should read --

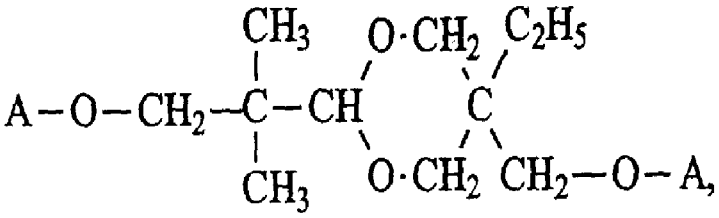

--

Column 23,
Line 63, “def ormation” should read -- deformation --.

Column 28,
Line 12, “mothacrylate” should read -- methacrylate --.

UNITED STATES PATENT AND TRADEMARK OFFICE

CERTIFICATE OF CORRECTION

PATENT NO. : 5,948,727
DATED : September 7, 1999
INVENTOR(S) : Yoshihiko Hotta et al.

It is certified that error appears in the above-identified patent and that said Letters Patent is hereby corrected as shown below:

Column 36,
Line 31, “63-221097” should read -- 63-221087 --.

Column 40,
Line 56, “thermoasensitive” should read -- thermosensitive --.

Column 42,
Line 4, “thermoasensitive” should read -- thermosensitive --.

Column 44,
Line 34, “100 th” should read -- $100^{th}$ --;
Line 59, “Ex. 9” should read -- Ex. 8 --;
Line 65, “1.9” should read -- 1.8 --.

Column 45,
Line 13, “0.61” should read -- 0.67 --;
Line 15, “0.97” should read -- 0.87 --;
Line 66, “90” should read -- 80 --.

Column 46,
Line 8, “85” should read -- 86 --;
Line 30, “Ex. 9” should read -- Ex. 8 --;
Line 31, “99” should read -- 89 --;
Line 34, “19” should read -- 18 --;
Line 38, “9” should read -- 8 --.

Signed and Sealed this

Eighteenth Day of June, 2002

*Attest:*

*Attesting Officer*

JAMES E. ROGAN
*Director of the United States Patent and Trademark Office*